US011085407B2

(12) United States Patent
Anderson et al.

(10) Patent No.: US 11,085,407 B2
(45) Date of Patent: Aug. 10, 2021

(54) FUEL SUPPLY MODULE AND CONTROL SYSTEM

(71) Applicant: Walbro LLC, Tucson, AZ (US)

(72) Inventors: Eric D. Anderson, West Bend, WI (US); Travis P. Baur, Bay Port, MI (US); Elton J. Fisch, Caro, MI (US); Cyrus M. Healy, Ubly, MI (US); Kevin L. Israelson, Cass City, MI (US); Gerald J. LaMarr, Jr., Bay City, MI (US); Robby L. Linton, Saginaw, MI (US); Edward J. Talaski, Caro, MI (US)

(73) Assignee: Walbro LLC, Cass City, MI (US)

( * ) Notice: Subject to any disclaimer, the term of this patent is extended or adjusted under 35 U.S.C. 154(b) by 249 days.

(21) Appl. No.: 16/329,928

(22) PCT Filed: Sep. 1, 2017

(86) PCT No.: PCT/US2017/049899
§ 371 (c)(1),
(2) Date: Mar. 1, 2019

(87) PCT Pub. No.: WO2018/045311
PCT Pub. Date: Mar. 8, 2018

(65) Prior Publication Data

US 2019/0242341 A1 Aug. 8, 2019

Related U.S. Application Data

(60) Provisional application No. 62/383,166, filed on Sep. 2, 2016, provisional application No. 62/426,836, filed
(Continued)

(51) Int. Cl.
*F02M 37/00* (2006.01)
*F02M 37/02* (2006.01)
(Continued)

(52) U.S. Cl.
CPC .... *F02M 37/0052* (2013.01); *F02M 37/0029* (2013.01); *F02M 37/025* (2013.01);
(Continued)

(58) Field of Classification Search
CPC ..... F02M 37/0052; F02M 37/0029; F02M 37/025; F02M 37/10; F02M 37/18; F02M 37/103; F02M 37/04; F02M 37/20
See application file for complete search history.

(56) References Cited

U.S. PATENT DOCUMENTS 4,831,990 A 5/1989 Tuckey
4,878,518 A 11/1989 Tuckey
(Continued)

OTHER PUBLICATIONS

Written Opinion & International Search Report for PCT/US2017/049899 dated Mar. 11, 2019, 17 pages.
(Continued)

*Primary Examiner* — Jacob M Amick
*Assistant Examiner* — Charles J Brauch
(74) *Attorney, Agent, or Firm* — Reising Ethington P.C.

(57) ABSTRACT

In at least some implementations, a fuel supply module includes a reservoir and a fuel pump carried by the reservoir. The reservoir may include a body and a lid that define an internal volume to contain a supply of fuel, and the reservoir may include an inlet through which fuel enters the internal volume and an outlet from which fuel is discharged from the fuel supply module. The fuel pump is carried by the reservoir and has a first inlet communicating with the internal volume to take fuel into the fuel pump from the internal volume and a second inlet spaced above the first inlet relative to the direction of the force of gravity to take fluid or vapors into the fuel pump from the internal volume. The fuel pump includes an outlet from which fluid is discharged for delivery to an engine through the reservoir outlet.

24 Claims, 10 Drawing Sheets

Related U.S. Application Data on Nov. 28, 2016, provisional application No. 62/477,663, filed on Mar. 28, 2017, provisional application No. 62/524,813, filed on Jun. 26, 2017.

(51) Int. Cl.
*F02M 37/10* (2006.01)
*F02M 37/18* (2006.01)
*F02M 37/04* (2006.01)

(52) U.S. Cl.
CPC ..... *F02M 37/10* (2013.01); *F02M 37/18* (2013.01); *F02M 37/04* (2013.01); *F02M 37/103* (2013.01)

(56) References Cited

U.S. PATENT DOCUMENTS 4,893,647 A 1/1990 Tuckey
5,560,342 A * 10/1996 Fournier ..... B01D 35/0273 123/509
5,715,797 A 2/1998 Minagawa et al.
5,809,975 A 9/1998 Tuckey et al.
5,960,775 A 10/1999 Tuckey
6,039,548 A 3/2000 Ley et al.
6,158,975 A * 12/2000 Dill ..... F02M 37/08 123/509
6,213,726 B1 4/2001 Tuckey
6,279,541 B1 8/2001 Doane et al.
7,101,239 B1 9/2006 Torgerud et al.
7,178,512 B1 2/2007 Merten
7,395,814 B1 7/2008 Doepke et al.
7,588,017 B2 * 9/2009 Briggs ..... F02M 37/025 123/509
7,832,380 B1 11/2010 Abou Zeid et al.
9,316,170 B2 * 4/2016 Song ..... F02D 41/3082

OTHER PUBLICATIONS

CN Office Action for CN Application No. 201780053859.0 dated Oct. 30, 2020 (13 pages).

* cited by examiner

FUEL SUPPLY MODULE AND CONTROL SYSTEM

REFERENCE TO RELATED APPLICATIONS

This application is a National Phase of PCT/US2017/049899 filed Sep. 1, 2017 which claims the benefit of U.S. Provisional Application Ser. No. 62/383,166 filed on Sep. 2, 2016; 62/426,836 filed on Nov. 28, 2016; 62/477,663 filed on Mar. 28, 2017 and 62/524,813 filed on Jun. 26, 2017, the entire contents of which are incorporated herein by reference in their entireties.

TECHNICAL FIELD

The present disclosure relates generally to a fuel supply module and a control system for delivering fuel under pressure for use by an engine.

BACKGROUND

A fuel pump may be included within a fuel supply module having a reservoir in which a supply of fuel is contained, and the fuel pump pumps fuel from the reservoir for use by an engine. The fluids within the reservoirs often include liquid fuel and also gasses like air and fuel vapors that collect in an upper region of the reservoir, above the liquid fuel. The fuel pump may include an electric motor that drives a pumping element to pump fuel from the reservoir. Improved control of the fuel pump motor is needed to improve the efficiency of the system, reduce electrical energy needed for the pump, and to improve the system performance, including the ability to provide fuel to the engine as a function of the fuel pressure and engine fuel demand. Further, it may be necessary or desirable to control purging of air and fuel vapor from the reservoir.

SUMMARY

In at least some implementations, a fuel supply module includes a reservoir and a fuel pump carried by the reservoir. The reservoir may include a body and a lid that define an internal volume to contain a supply of fuel, and the reservoir may include an inlet through which fuel enters the internal volume and an outlet from which fuel is discharged from the fuel supply module. The fuel pump is carried by the reservoir and has a first inlet communicating with the internal volume to take fuel into the fuel pump from the internal volume and a second inlet spaced above the first inlet relative to the direction of the force of gravity to take fluid into the fuel pump from the internal volume. The fuel pump includes an outlet from which fluid is discharged for delivery to an engine through the reservoir outlet.

In at least some implementations, a fuel supply module includes a reservoir, a fuel pump carried by the reservoir and a manifold communicated with the fuel pump. The reservoir has an internal volume to contain a supply of fuel, an inlet through which fuel enters the internal volume and an outlet from which fuel is discharged from the fuel supply module. The fuel pump has a first inlet communicating with the internal volume to take fuel into the fuel pump from the internal volume and an outlet from which pressurized fuel is discharged. And the manifold has an inlet communicated with the fuel pump outlet, a first outlet communicating with the reservoir outlet and a second outlet communicating with a pressure sensor. The manifold and the pressure sensor are received within the internal volume with the pressure sensor received between the manifold and reservoir and not directly communicated with the internal volume.

In at least some implementations, a control system for a fuel pump includes a controller having or associated with memory that includes instructions or programs for operation of the controller. The controller also includes:

at least one input which may include an output from a fuel pressure or fuel flow sensor, an output from a controller associated with an engine with which the fuel pump is used, a throttle position sensor of the engine, an indication of engine fuel demand and a power supply for the fuel pump; and an output to the fuel pump of a power supply the magnitude of which is dependent upon at least one of the inputs.

In at least some implementations, a method of operating a fuel pump includes:

determining the difference between a set current or speed value to be provided to the fuel pump and an actual current or speed value provided to the fuel pump;

adding said difference to a previous current value to provide a commanded current that is provided to the fuel pump; and storing the commanded current as a previous current.

BRIEF DESCRIPTION OF THE DRAWINGS

The following detailed description of certain embodiments and best mode will be set forth with reference to the accompanying drawings, in which.

DETAILED DESCRIPTION

Figure 1:
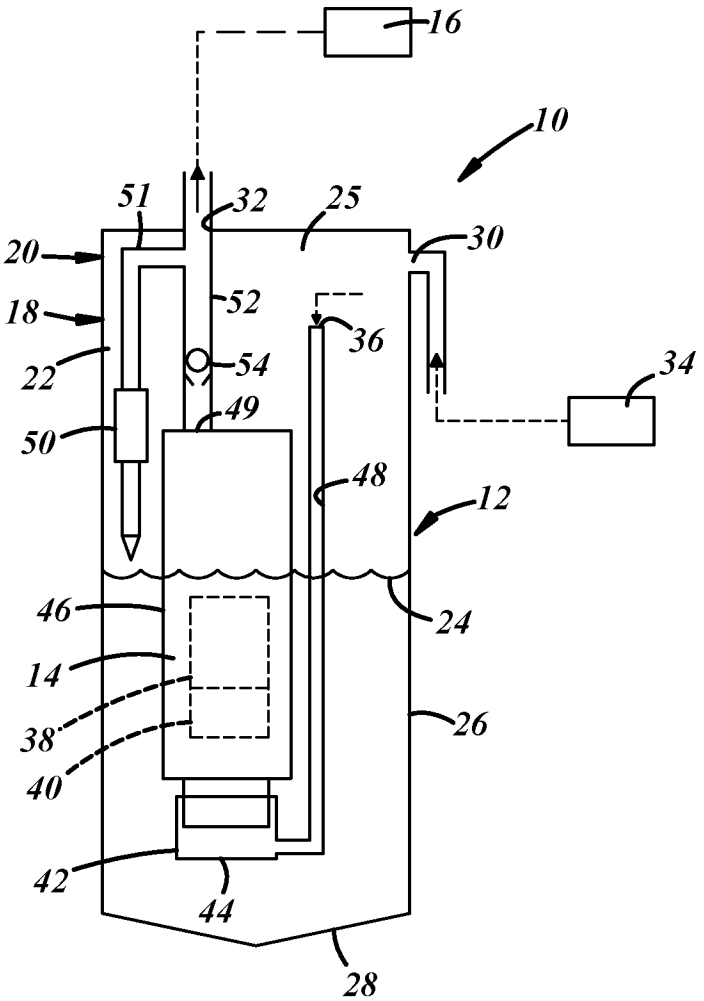
FIG. 1 is a diagrammatic view of a fuel supply module.

Referring in more detail to the drawings, FIG. 1 illustrates a fuel supply module 10 having a reservoir 12 in which a supply of fuel is contained and a fuel pump 14 to pump fuel from the reservoir 12 for use by an engine 16. The reservoir 12 may include or be defined by a main body 18 and a lid 20 that together define an internal volume 22 in which fluid is retained. The fluid often includes liquid fuel 24 and also gasses like air and fuel vapors that collect in an upper region 25 above the liquid fuel (above with regard to the direction of gravitational force). The fuel pump 14 takes in fuel from the internal volume 22, increases the pressure of the fuel and discharges fuel under pressure for delivery to the engine 16.

The body 18 and lid 20 of the reservoir 12 may be formed from any desired material suitable for use with the fuel being pumped. To prevent leakage from the reservoir 12, the lid 20 may be sealed to the body 18. The reservoir 12 may be of any desired shape and provide any desired internal volume 22. In the example shown, the body 18 has a generally cylindrical sidewall 26 that is closed at one end by a bottom wall 28 and open at its other end so that components (e.g. the fuel pump) can be received within the internal volume 22 before the lid 20 is coupled to the main body 18 to close the upper, open end of the main body and enclose the internal volume 22. In at least some implementations, the reservoir 12 includes an inlet 30 through which fuel is admitted into the internal volume 22 and an outlet 32 from which fuel is discharged from the reservoir 12. The inlet 30 may be open to the internal volume 22 at a level above an inlet of the fuel pump 14 to avoid draining of fuel from the internal volume under the force of gravity or under an internal pressure that may be present within the internal volume. In at least some implementations, the inlet 30 opens into the internal volume 22 at a location that is closer to the upper wall or lid 20 than the bottom wall 28 of the reservoir 12, and in the implementation shown, the inlet 30 is located within a distance of the upper wall 20 that is within 1% to 50% of the total height of the internal volume 22. A secondary fuel pump, sometimes called a lift pump, may be provided either inside or outside of the internal volume to pump fuel from a fuel supply 34 (e.g. a fuel tank) into the internal volume 22 through the inlet 30, if desired. In the example shown in FIG. 1, the upper region 25 of the reservoir 12 is not vented, that is, the gaseous matter in the upper region 25 is not able to exit the internal volume 22 via a vent or vent valve. Instead, the gaseous matter is taken into the fuel pump 14 through a second inlet 36 that opens into the upper region 25 as will be set forth in more detail below.

The fuel pump 14 may include an electric motor 38 and a pumping element 40 driven by the motor. The pumping element 40 may be a of a positive displacement type, like a gerotor or screw pump, or a centripetal pump like a turbine type pump. To take-in fuel from the internal volume 22, the fuel pump 14 has a first inlet 42. The first inlet 42 may be arranged in the internal volume 22 so that it is closer to the bottom wall 28 of the reservoir 12. In some implementations, the first inlet 42 is within a bottom third of the height of the internal volume 22 (relative to the force of gravity) and may be within the bottom 10% of the height of the internal volume. In this position, the first inlet 42 may be submerged in liquid fuel during normal operation of the module 10, which may include all or nearly all instances except where the main fuel tank 34 is low on fuel and when the reservoir 12 has a low level of or no fuel therein. This maintains a head of liquid at the first inlet 42, and the first inlet wetted to improve the performance and efficiency of the pump 14. In the example shown, the first inlet 42 is of a relatively small size, and may be defined in a body 44 separate from the fuel pump, such as the inlet body 44 that is coupled to the housing 46 of the fuel pump 14 or the first inlet 42 may be defined in or by the housing 46. In at least some implementations, the first inlet 42 may have a size (e.g. diameter) of between 1 mm and 12 mm. The inlet body 44 may include the second inlet 36 open to the upper region 25 and through which gaseous matter is drawn into a tube or other passage 48 that leads to the first inlet 42. In at least certain circumstances, some gaseous matter will be drawn through the second inlet 36, the passage 48 and into the fuel pump 14, and will thereafter be discharged from an outlet 49 of the fuel pump 14 in a mixture with liquid fuel discharged from the fuel pump.

To control when the gaseous matter is drawn into the fuel pump 14, the first inlet 42 may be sized to restrict fluid flow therethrough. Further, the motor 38 may be driven at variable speed, and the flow rate of fuel drawn into the fuel pump 14 varies as a function of the motor speed. When the flow rate of fuel through the fuel pump 14 is below a threshold, the pressure drop across the second inlet 36 is not sufficient to pull air through the tube 48, liquid fuel remains in the tube and air is not purged from the reservoir 12. When the flow rate of fuel through the fuel pump 14 is above a threshold rate, the pressure drop across the second inlet 36 is great enough to draw the fluid out of the tube 48 and draw air through the tube. As air is drawn through the tube 48 and purged from the reservoir 12, the level of fuel in the reservoir 12 increases or rises until liquid fuel is at the level of the second inlet 36. At that fuel level, any air above the surface of the fuel is trapped in the reservoir 12 and is not purged, and the pump 14 takes in and pumps out liquid fuel. In at least some implementations, the reservoir inlet 30 is arranged at a height (relative to gravity) that is above the height of the second inlet 36 so that the fuel level in the internal volume 22 remains below the level of the reservoir inlet 30 and fuel does not flow back into the fuel tank 34 through the reservoir inlet. Of course, other arrangements may be used, and a check valve may be added regardless of the relative height of the reservoir inlet 30 to prevent the reverse flow of fuel to the fuel tank 34, if desired.

A check valve 50 may be provided in a branch passage 51 communicated with the fuel pump outlet 49 to return to the reservoir 12 fuel discharged from the fuel pump 14 at a flow rate greater than is demanded by the engine 16. The valve 50 may be biased, such as by a spring, so that the valve only opens when the fuel acting on the valve is above a threshold pressure. In this way, the valve 50 may act as a pressure regulator that bypasses fuel over a desired maximum pressure back to the reservoir 12. The valve 50 may also maintain some fuel in the fuel lines 52 downstream of the fuel pump to, for example, facilitate starting an engine by maintaining a supply of fuel ready to be delivered to the engine at initial cranking of the engine. If fuel were not maintained in the fuel lines 52 leading to the engine 16, then those fuel lines would have to first be filled with fuel before fuel is delivered to the engine. A second check valve 54 may be provided in the pump 14 or downstream thereof and is arranged to permit fuel under pressure to be discharged from the fuel pump 14 but to prevent the reverse flow of fuel back into the reservoir 12 through the fuel pump.

The length or height of the tube 48 (and hence, the height of the second inlet 36) is one factor that determines the flow rate of fuel needed to cause a pressure drop sufficient to draw air through the tube 48. In at least some implementations, the tube 48 may be between 2 and 16 inches in length, measured from the second inlet 36 to a lowest point of the tube 48. And the second inlet 36 may be located above a centerline or mid-level of the internal volume 22 (measured from a top to the bottom of the internal volume). In some implementations the second inlet 36 may be within an upper one-third of the internal volume 22, and in some implementations may be within 10% of the top of the internal volume (i.e. within a distance from the top or highest point in the internal volume that is 10% or less than the total height of the internal volume from the top to the bottom of the internal volume).

Another factor that determines the flow rate of air drawn through the tube 48 is the size of the second inlet 36. The first inlet 42 can be sized to provide a pressure drop at a threshold flow rate that is sufficient to purge air from the reservoir 12, but which does not purge air at flow rates below the threshold. For example, this can prevent air from being purged when the engine 16 is idling or at low speeds wherein providing a supply of air to the engine could unduly or negatively impact engine operation. At higher speeds, the engine 16 may better handle a temporary supply of air as the air is purged. Accordingly, the first and second inlets 36, 42 may be sized to ensure that air is not purged from the reservoir 12 until a sufficient or threshold flow rate of fuel is demanded by the engine 16 and delivered by the fuel pump 14. In at least some implementations, the second inlet 36 has a diameter of between 0.1 mm and 3 mm or larger (e.g. up to 7 mm in some implementations), and a pressure drop of between about 0.05 psi to 0.5 psi is needed to draw air through the tube. In at least some implementations, the system may be calibrated or constructed so that the flow of air begins when the flow of fuel to the engine is 25% to 75% of the flow required to support wide open throttle engine operation. A smaller size for the first inlet 42 in combination with a larger size for the second inlet 36 may permit the air to be purged before the engine starts or is idling, although this may delay engine starting slightly it may improve subsequent system operation and performance. Alternatively, a smaller size for the second inlet 36 may allow slower air purging with less impact on engine operation.

Figure 2:
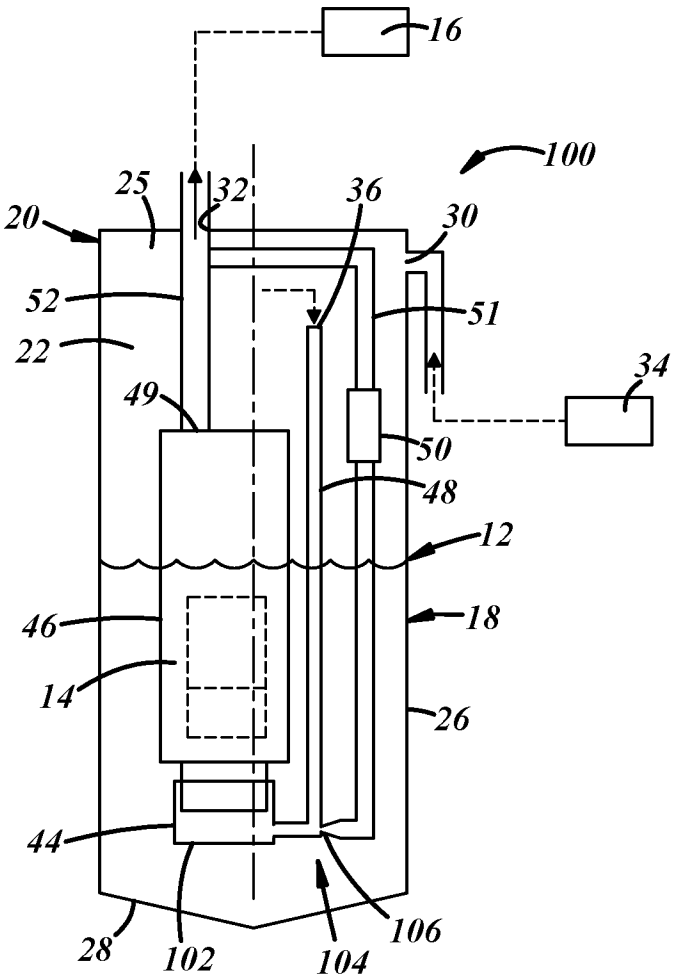
FIG. 2 is a diagrammatic view of another fuel supply module.

In FIG. 2, a fuel supply module 100 includes a reservoir 12 that may include a body 18 and a lid 20, and a fuel pump 14 in the reservoir, as set forth with regard to the module shown in FIG. 1. Components of the module 100 that are the same as or similar to components of module 10 may be given the same reference numbers to facilitate description and understanding of the module 100.

In this example, a first inlet 102 to the fuel pump 14 is not restricted (i.e. there is no significant pressure drop at the inlet due to fuel flowing into the inlet). Instead, the pressure drop needed to draw air through the tube or passage 48 is provided by a jet pump 104 (which maybe oriented so that the flow through the jet pump is perpendicular to the direction of the force of gravity). In the example shown, the jet pump 104 includes an orifice or nozzle 106 that, under at least some operating conditions, discharges fluid into the passage 48 and thereby creates a pressure drop in the passage 48 to draw in fluid through the second inlet 36. The jet pump 104 could be powered by a portion of the fuel discharged from the fuel pump outlet 49 before that fuel is delivered to the engine 16, and in some instances before the fuel is discharged from the reservoir 12, or the jet pump 104 could be powered by a different fuel flow such as from a different fuel pump, or from fuel that is returned to the reservoir 12 after flowing to a fuel rail or an injector or a pressure regulator downstream or inside of the reservoir. From whatever source, the velocity of fluid flow out of the nozzle 106 and into the tube 48 determines the magnitude of the pressure drop caused thereby. When the pressure drop so caused is greater than a threshold value or magnitude, fluid will be drawn through the second inlet 36 to purge air from the reservoir until the level of liquid fuel in the internal volume 22 reaches the second inlet 36 at which point only liquid fuel will be taken into the passage 48 and pump 14. Also, the orientation, sizes and vertical location (e.g. height relative to direction of gravity) of the jet pump relative to the inlet are parameters that affect its operation.

In the example shown, a check valve 50 is provided in a bypass line 51 that communicates at one end with the fuel pump outlet 49 and at the other end with the nozzle 106. The check valve 50 is arranged to open when acted upon by a pressure above a second threshold and is not open so that fuel does not flow to the nozzle 106 when the pressure of fuel discharged from the fuel pump 14 is below the second threshold. Hence, if the fuel pump 14 is variably driven (i.e. at different speeds or power inputs) to provide an output of fuel at different pressures, the check valve 50 may remain closed during lower pressure fuel pump operation, which may be associated with low speed and low power engine operation. This may avoid drawing in a relatively large supply of air at once and delivering that air to the engine 16 when the engine is operating at low speed and power. The lower pressure fuel pump operation could otherwise be associated with a low voltage condition such as may occur during a cold start of the engine 16 (e.g. in a system wherein the fuel pump output pressure is designed to be relatively uniform to provide a generally consistent pressure drop across fuel injectors that deliver fuel to the engine). During low voltage operation of the fuel pump 14, it may be desirable to avoid bypassing fuel to the nozzle 106 and instead provide all or substantially all of the fuel to the engine 16 to support engine operation. During normal fuel pump operation, the output fuel pressure may be sufficient to open the check valve 50 and provide fuel to the nozzle 106, and such fuel flow through the nozzle may be at sufficient velocity to draw air through the passage 48 and purge air from the internal volume 22. In at least some implementations, the check valve 50 may open when the fuel pressure is between 20% to 80% of the nominal maximum fuel pressure in the system, with some systems provided with a check valve that opens at a pressure between 40% and 60% of the maximum fuel pressure. The nozzle 106 may have a flow area between 0.05 $mm^2$ and 0.30 $mm^2$, in at least some implementations, such as those wherein the maximum fuel pressure is between 250 kpa and 475 kpa. In another scenario, the check valve is always or normally open and the nozzle has a small area allowing relatively consistent air purging in a variety of conditions.

Figure 3:
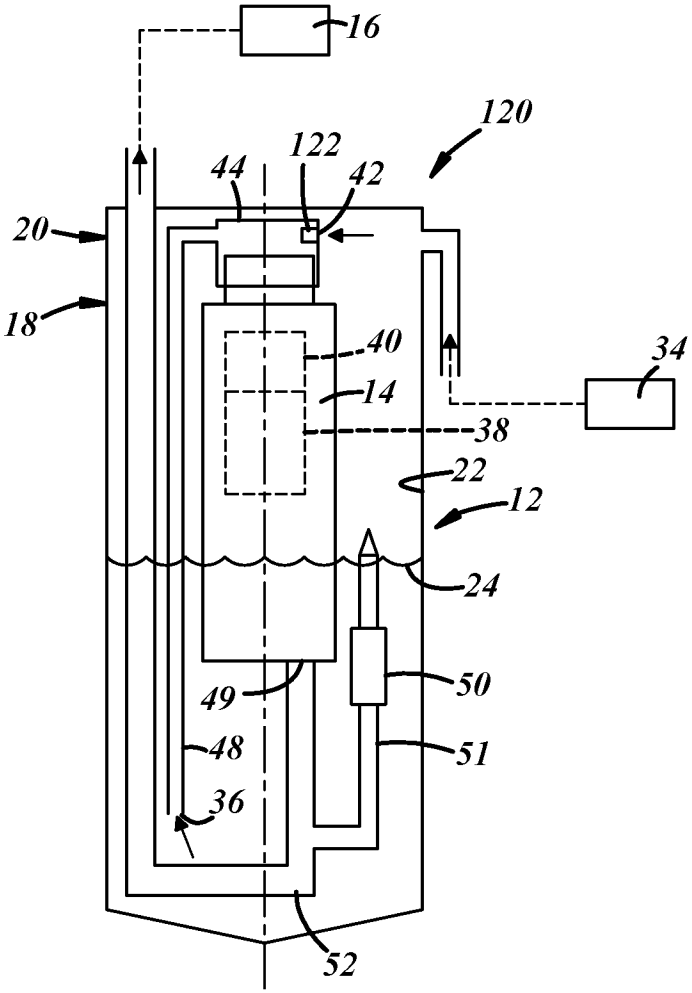
FIG. 3 is a diagrammatic view of another fuel supply module.

The fuel supply module 120 of FIG. 3 may be similar in at least some ways to the previously described fuel supply modules 10, 100 and the same reference numbers may be used for components that are the same as or similar to the components previously described. This module 120 may also include a reservoir 12 having a main body 18 and a lid 20, and a fuel pump 14 carried by the reservoir.

In this example, the fuel pump 14 is inverted so that the pump first inlet 42 is located above the pump outlet 49 relative to the direction of gravity. So arranged, the first inlet 42 may be oriented in an air space above the level of liquid fuel 24 under at least some conditions, such as when the fuel pump 14 is not operating. In this example, the inlet tube 48 leads to a second inlet 36 that is submerged in liquid fuel and through which liquid fuel is drawn into the fuel pump 14 during operation of the fuel pump. Hence, when the fuel pump 14 is operating, air is drawn into the first inlet 42 and fuel is drawn into the second inlet 36 and delivered to the fuel pump through the inlet tube 48. The rate at which fuel and air are drawn into the fuel pump 14 varies according to the flow rate of fluid through the fuel pump, which may be varied as desired. The size of the first inlet 42 may be small to limit the flow rate of air into the first inlet, and hence, limit the rate at which air is discharged from the fuel pump 14. In this arrangement, air will flow into the fuel pump 14 for as long as the fuel pump is operating and until the level of fuel in the internal volume 22 covers the first inlet 42.

In at least some implementations, the first inlet 42 is between 0.1 mm and 1 mm in diameter (and/or the flow area is between 0.0075 to 0.785 $mm^2$) and is sized to control the flow rate of air therethrough. A filter or screen 122 may be used to inhibit the inlet 42 from becoming blocked by contaminants in use. A check valve 50 in a bypass line 51 that is communicated with the pump outlet 49 may be used to limit the maximum pressure of fuel delivered from the module 120.

Accordingly, several examples fuel supply modules 10, 100, 120 have been shown wherein air within the module is drawn into a fuel pump 14 and delivered from the module with liquid fuel discharged from the fuel pump. Fuel and air may be drawn from the reservoir 12 and delivered therefrom by a single pump 14, if desired. The modules 10, 100, 120 thus do not need to have vent valves which would add cost to the module. Further, the vent valves often used include a floating valve element to close the valve at higher fuel levels in the module which adds complexity to the system and can be the source of fuel and/or hydrocarbon leakage from the module. Further, such vented modules often include a vapor canister to remove hydrocarbons from the vented gasses and vent to the atmosphere essentially clean air. These canisters also would add cost and complexity to the system. At least some of the modules 10, 100, 120 provide a way to vent air from the reservoir with a single pump, and without use of an inverted pump so that fuel may be more easily drawn in by the pump without pressure losses associated with an inverted pump and drawing fuel through a tube to an elevated pump inlet. While a single air inlet 36 or 42 is shown in the examples of FIGS. 1 to 3, multiple air inlets may be provided and the air inlets may have different sizes and be located at different vertical locations within the internal volume to vary the flow rate of air from the module in accordance with, for example, the fuel level in the module or as a function of the pressure drop created by the fuel pump.

Figure 4:
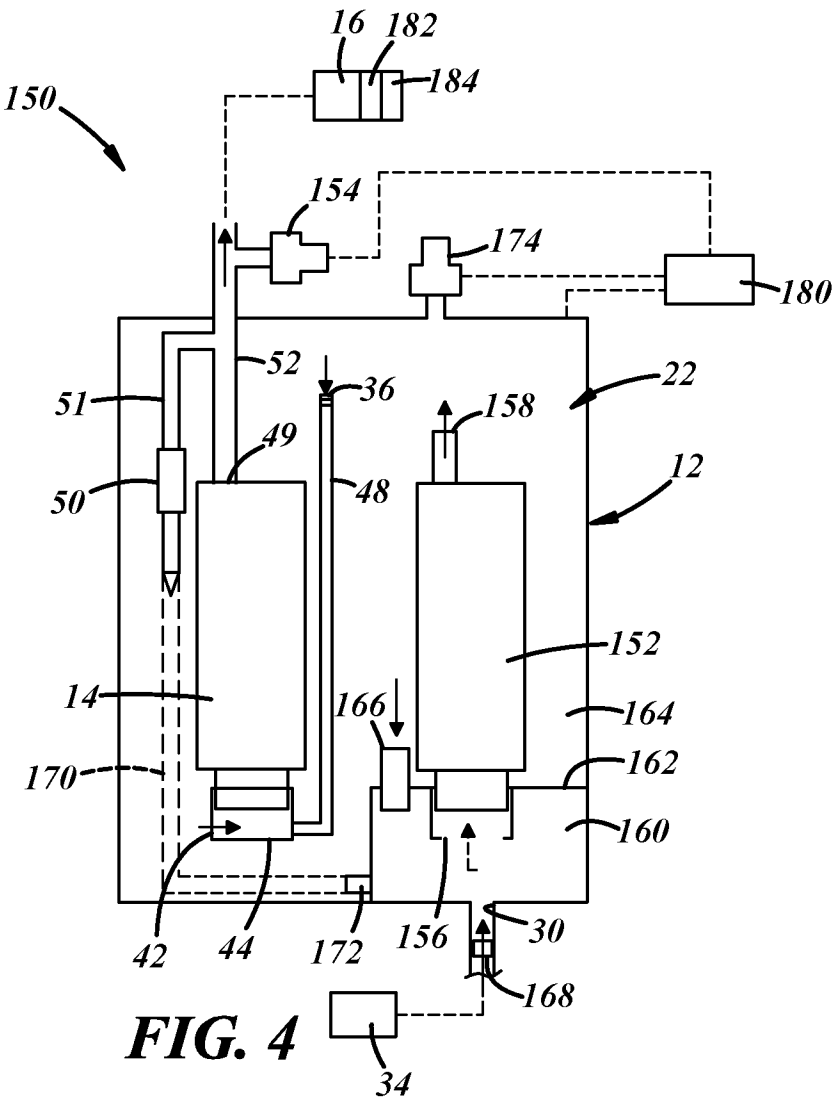
FIG. 4 is a diagrammatic view of another fuel supply module.

As shown in FIG. 4, a fuel supply module 150 may include more than one fuel pump. A first fuel pump 14 may be arranged to pump fuel from the internal volume 22 and discharge the fuel from the module 150 under pressure for use by an engine 16, and a second fuel pump 152 may be arranged to pump fuel into the internal volume 22 of the reservoir 12 from a fuel supply 34 (e.g. a fuel tank). The first pump 14 may be constructed and arranged as shown in FIG. 1 and described above, including a restricted first inlet 42, an inlet tube 48 having a second inlet 36 through which air and/or fuel may be drawn into the first pump, and a bypass passage 51 and check valve 50 through which fuel discharged from the first pump may be routed to the internal volume 22 or elsewhere, as desired. As shown in FIG. 4, a pressure sensor 154 may be associated with the outlet of the first pump 14 to determine a pressure of fuel discharged from the first pump (via outlet 49 and fuel line 52).

The second pump 152 may be a positive displacement pump or any other suitable type of pump (for example a turbine type or a diaphragm type pump) to move fuel from a fuel supply 34 into the reservoir 12. The second pump 152 has an inlet 156 in communication with an inlet 30 of the reservoir 12 and an outlet 158 in communication with the internal volume 22 and thereby, with the first inlet 42 of the first pump 14. The second pump inlet 156 may be open to an inlet chamber 160 defined by an internal wall 162 of the reservoir 12 and the inlet chamber 160 may be separate from the remainder of the internal volume 22, which may be called the primary chamber 164. In this way, the pressure drop created by the second pump 152 is communicated with the inlet chamber 160 and not with the primary chamber 164 so that the second pump 152 does not draw in fuel from the primary chamber 164 and that fuel is available to the first pump 14. A check valve 166 may be provided between the inlet chamber 160 and primary chamber 164 to permit fuel to flow from the primary chamber 164 into the inlet chamber 160 to ensure that the second pump 152 remains wetted, or has its inlet 156 submerged in liquid fuel at least when a sufficient fuel supply exists in the primary chamber 164. Likewise, a check valve 168 may be provided between the inlet chamber 160 and the fuel supply 34 to prevent fuel in the inlet chamber from returning to the fuel supply. Finally, an alternate assembly may provide fuel from the bypass passage 51 to the inlet chamber 160, and as shown by the dashed lines 170, that passage 51 may feed into the inlet chamber 160 through a check valve 172, if desired, to prevent the reverse flow of fuel out of the inlet chamber 160. Also, the use of this circuit assures that both pumps are wetted and/or not running dry.

When the first pump 14 is driven at a variable rate or speed or to provide a variable output flow rate, the second pump 152 may also be driven at a variable rate to ensure a sufficient supply of fuel to the first pump to meet the demand of the engine 16. In one example, the second pump 152 may be driven as a function of the pressure within the primary chamber 164, as may be determined or sensed by a second pressure sensor 174. Accordingly, when the pressure within the primary chamber 164 is below a desired value, the second pump 152 may be turned on to provide more fuel into the primary chamber 104, or if the second pump is already operating, the output of the second pump may be increased (e.g. the speed of the pump motor may be increased to increase the output flow rate). In this way, a consistent pressure and a consistent volume of fuel may be maintained in the primary chamber 164 that is available to be pumped by the first pump 14. As noted above, the pressure sensor 154 monitors the pressure at the outlet 49 of the first pump 14, and the output of the first pump 14 may be driven as a function of the pressure at pressure sensor 154 so that when the engine is consuming less fuel the first pump 14 can output fuel at a lower rate, and vice versa. Accordingly, the second pump 152 may be driven as a function of the pressure sensed at pressure sensor 174 and the first pump may be driven as a function of the pressure sensed at pressure sensor 154. In some instances, a pressure of 60 to 90 kPa may be desired within the primary chamber 164 and when the pressure sensed at pressure sensor 174 is less than the set threshold, the second pump 152 may be driven to provide fuel (or to provide fuel at a higher rate if already providing fuel). Similarly, the output of the second pump 152 may be regulated by an optional pressure regulator (such as diagrammatically shown at 166) that opens into the primary chamber 164 and through which fuel is provided into the primary chamber when the pressure in the primary chamber is above a threshold pressure. The regulator may be a diaphragm type, or biased check valve, or of other construction, as desired. The regulator may open when a pressure differential greater than a threshold (e.g. 60 to 90 kPa) exists across the regulator to permit fuel flow into the primary chamber. As one example, the pressure regulator may be a bypass type regulator in which a bypass valve is opened when the pressure is above a threshold pressure. A pressure switch or flow sensor may be used to detect bypass fuel flow and an output from the switch or sensor may be used to control the second pump.

The first and second pumps 14, 152 may be brush type pumps or brushless pumps, and they may be driven with a variable voltage or by a pulse width modulated signal to vary the outputs of the pumps. For example, the speed and/or output flow rate of the fuel pumps 14, 152 changes when a change is made to the electrical power supplied to the fuel pumps. A lower voltage supplied to the fuel pumps 14, 152 results in a lower speed and/or output flow rate and may result in lower current draw from the fuel pumps. In this way, the energy needed to drive the pumps can be tailored to the demand of the fuel system or engine and a reduction in the energy needed to drive the pumps can be realized. This reduction in energy also leads to a reduction in the heat generated in the system and the heat provided to the fuel. Reduction in the heat provided to the fuel can reduce the vaporization of fuel and enable a more consistent supply of liquid fuel from the module 150 (e.g. liquid fuel with less gaseous matter entrained therewith). The reduction in vapor generation may also enable reduction in the energy needed to operate the fuel pumps because the output including less vapor/gasses will more readily satisfy the engine fuel demand. Reduction in the heat of the fuel pumps can extend the life of the fuel pumps and may eliminate the need to provide secondary cooling of the fuel pumps or the fuel supply module, such as water cooling of the fuel pumps in marine applications (e.g. with a water jacket or water chamber through which water is pumped in use). The flow of fuel through the pumps, and the supply of fuel around the exterior of the fuel pumps may be sufficient to cool the pumps without secondary cooling of the fuel pumps. These benefits may also be provided in the modules 10, 100 and 120 which may utilize variable/driven pumps 14.

Next, the second pump 152 can be driven as a function of the output of the first pump 14 without need for the pressure sensor 174 that monitors the pressure of the primary chamber. The second pump 152 could, for example, be linked to a pressure regulator 166 allowing excess flow to be diverted to the primary chamber 164. The second pump 152 may be otherwise controlled to ensure that the second pump provides enough fuel into the primary chamber 164 in combination with the pressure regulator 166 to support the operation of the first pump 14. For example, the current draw or driving frequency of the first pump 14 may be monitored or sensed and used as an input for a controller 180 that controls operation of the second pump 152. In use, the current draw or driving frequency of the first pump 14 can be correlated with an output fuel flow rate and that information can be used to control operation of the second pump 152 so that sufficient fuel is provided into the primary chamber 164 to support operation of the first pump 14. Further, the second pump 152 may be regulated by sensing the voltage and current draw of the second pump, and by changing the current provided to the second pump as desired to change the output of the second pump. Additionally, a flow meter or other sensor of the flow rate of fuel out of the pressure regulator 166 may be provided and an output from such a meter or sensor may be used to control the second pump 152. Further, with inclusion of the pressure regulator 166 the second pump 152 may be controlled as a function of engine demand which may be determined via feedback from one or more engine systems. For example, a throttle position sensor 182 may provide information about engine fuel demand, as could the operation of fuel injectors (e.g. a duty cycle of the solenoids 184 or other electromechanical valves of the injectors) or other systems associated with the engine 16. Accordingly, the flow rate of the first pump 14 may be matched to the fuel system requirements (e.g. engine fuel demand) and the flow rate of the second pump 152 can be controlled as a function of the needs of the first pump 14 to reduce energy needed to drive both pumps 14, 152, reduce heat generated by both pumps, and reduce heating of the fuel.

The first pump 14 may provide fuel at a relatively high pressure, such as between 120 kPa and 1,000 kPa and this may be true of pump 14 in at least some implementations of the other modules 10, 100, 120 disclosed herein. The second pump 152 may provide fuel at a pressure of between 10 kPa and 200 kPa. The fuel supply module 150 may be adapted for use with a marine vehicle (e.g. a boat or personal watercraft, or a land based vehicle). Both the first pump 14 and second pump 152 may be oriented with their inlets lower than their outlets to facilitate drawing in fuel from the inlet chamber 160 and primary chamber 164. If desired, either or both pumps could be inverted.

Further, the current draw of the second pump 152 can be monitored to determine if the second pump is pumping fuel or if there is not sufficient fuel at the inlet 156 of the second pump. For situations in which it is unknown if the second pump 152 is pumping liquid fuel, the current draw of the pump will change (in general, it will be lower) if fuel is not available at the inlet 156 of the second pump. Hence, detecting a different (e.g. lower) than expected current draw of the second pump for a threshold period of time can be used as an indication that the supply of fuel to the inlet chamber 160 has ceased, at least for such period of time. This may occur if the main fuel tank 34 is empty or near empty, or due to sloshing or other movement of fuel in the main tank 34 which renders the fuel temporarily unavailable to the inlet chamber 160. To prevent damage to the fuel pump 152 which may occur if it is run in a dry condition for too long (e.g. due to a lack of cooling normally provided by the flow of liquid fuel through the pump), operation of the second pump 152 may be ceased when the low current draw condition is sensed or determined for at least the threshold period. When insufficient fuel is available to be pumped by the first pump 14 to support engine operation, the engine 16 will cease running although this may occur later than when the second pump 152 is no longer pumping fuel due to the volume of fuel in the primary chamber 164.

In at least some implementations, when the main fuel tank 34 is empty, the operator will have to rectify that condition and then, upon restarting or attempted restarting of the engine 16, the second pump 152 will again be operational (for example, turning an ignition key to an off position may reset the system so that the pump is again operational when the ignition key is turned to the on or start position, or turning off of the power when the engine stalls may reset the system so that the system is again available upon attempted restarting of the engine whether a key is used or not). In the case where fuel slosh or movement in the main fuel tank 34 rendered fuel unavailable to the inlet chamber 160 and primary chamber 164, attempted restarting of the engine 16 may be successful if fuel is available to the inlet chamber 160 and the second pump 152 can be made operational to support the attempted restarting of the engine. Here, the operator may be alerted to the low fuel condition and hence, seek additional fuel to add to the main fuel tank.

Figure 5:
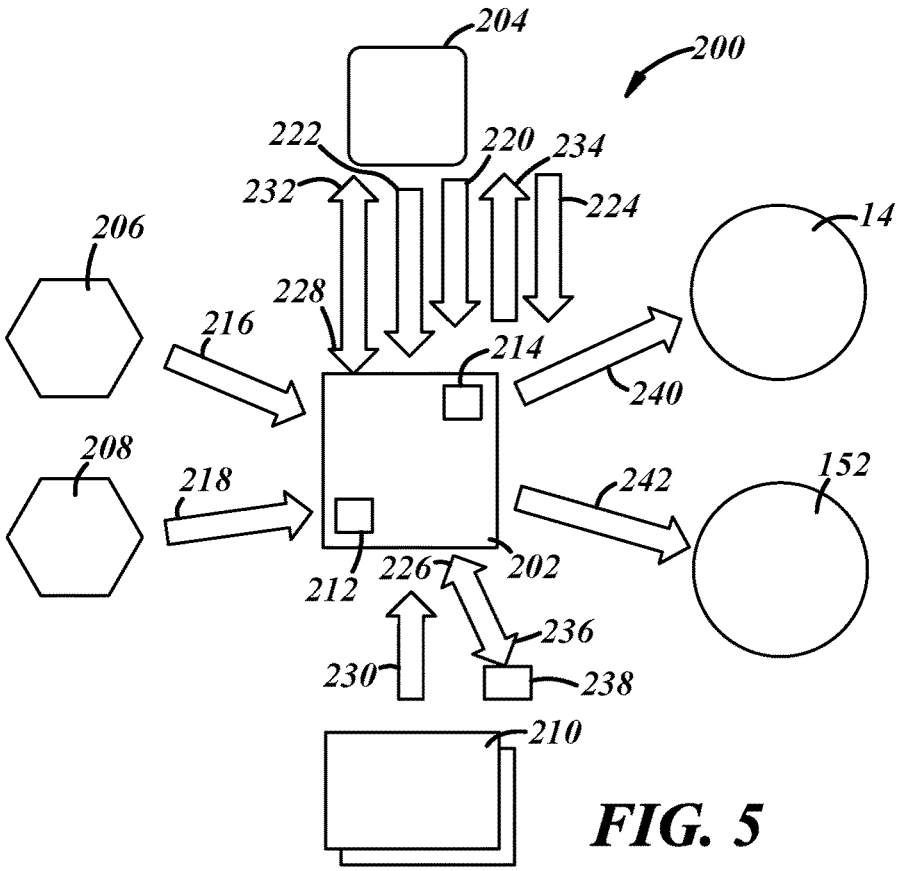
FIG. 5 is a diagrammatic view of a control system for a fuel pump.

FIG. 5 illustrates a control system 200 that includes a fuel pump controller 202 operable to control one or more fuel pumps 14, 152 in a fuel system. The pump controller 202 may be communicated with a vehicle or engine controller 204 to provide information to the engine controller and to receive information from the engine controller. The pump controller 202 may also be communicated with one or more sensors, such as pressure sensor(s) 206, pressure regulator bypass flow rate sensor(s) 208, fuel injector voltage sensor or the like, and with a power source 210 for the fuel pump(s), such as a battery. Further, the pump controller 202 may include or be associated with memory or storage 212 that contains operating instructions or other programs and algorithms, as well as operational data associated with the engine, pump(s) or both the engine and pump(s). Communication with the pump controller 202 may be effected via one or more wires, or wirelessly by a wireless transmitter 214 (utilizing any desired protocol, for example, wifi or bluetooth or other) to, for example, provide programs or other information to the controller or to receive data or other information from the controller. In some implementations, the pump controller 202 may be located within the housing 46 of the fuel pump 14 or fuel reservoir, and may be cooled by fuel flow through the fuel pump, or the pump controller may be located outside of the fuel pump and communicated therewith via one or more wires.

The memory 212 may include any non-transitory computer usable or computer readable medium, which may include one or more storage devices or articles. Exemplary non-transitory computer usable storage devices include conventional computer system RAM (random access memory), ROM (read only memory), EPROM (erasable, programmable ROM), EEPROM (electrically erasable, programmable ROM), and magnetic or optical disks or tapes. In at least one embodiment, the controller 202 memory includes an EEPROM device or a flash memory device.

The controller 202 may also include or be associated with one or more processors that can be any type of device capable of processing electronic instructions including microprocessors, microcontrollers, electronic control circuits comprising integrated or discrete components, application specific integrated circuits (ASICs), and the like. The processor(s) can be a dedicated processor(s)—used only for the pump controller—or it can be shared with other vehicle or engine systems. Processor(s) execute various types of digitally-stored instructions, such as software or firmware programs which may be stored in memory, which enable the pump controller to function. For instance, processor(s) can execute programs, process data and/or instructions, and thereby control at least one attribute of the fuel pump(s) as discussed herein. In at least one embodiment, processor(s) may be configured in hardware, software, or both.

In the example shown in FIG. 5, the pump controller 202 uses one or more inputs to control the operation of two pumps, such as the first and second pumps 14, 152 described with reference to FIG. 4. Representative inputs provided to the controller include the outputs 216, 218 from one or more pressure sensors or flow sensors (e.g. the pressure sensors 154, 174 shown in FIG. 4), an output 220 from a throttle position sensor 182 that may be provided from the engine controller 204 (or directly from the sensor), an output 222 from a pressure sensor responsive to engine manifold pressure, and an output 224 from a sensor that determines engine fuel demand. Further inputs include input 226 that permits information to be stored in a memory associated with the pump controller, input 228 that receives data from the engine controller to be stored at least temporarily in the pump controller storage, input 230 which receives power supplied from the power source and fuel injector voltage data and input from a sensor that measures bypass flow. Representative outputs from the pump controller 202 include an output 232 including data or other information (e.g. pump operational data and diagnostic information) to the engine controller 204, an output 234 indicative of fuel pressure to the engine controller, an output 236 for diagnostic or other data to an exterior source 238 (e.g. a computer or diagnostic equipment), an output 240 for the first pump 14 and an output 242 for the second pump 152. Outputs 240 and 242 may be electrical power outputs wherein the voltage supplied to the pumps 14, 152 may be varied in accordance with a fuel demand needed from the pumps. In this way, the fuel pump(s) 14, 152 can be controlled as desired, and in accordance with the various possibilities noted herein. Further, the operation of the fuel pumps 14, 152 can be communicated with the engine controller 204 to ensure and enable desired operation of the engine 16 and fuel system together. This may facilitate operating the fuel pumps 14, 152 in accordance with actual demand to, among other things, reduce energy consumption and heat generation, as noted above.

Figure 6:
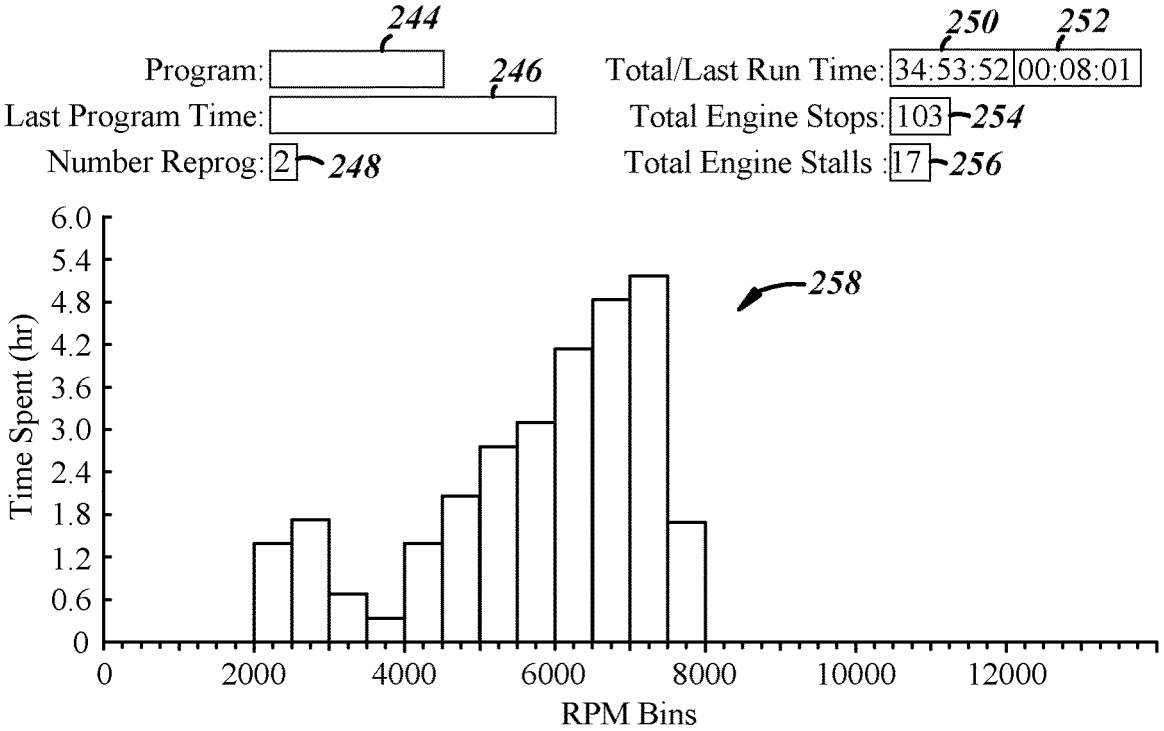
FIG. 6 is a graph of representative fuel pump operation data.

FIG. 6 includes a graph and related data that may be shared between the pump controller 202 and the engine controller 204 or provided to an exterior source 238. Other data and things may be communicated in addition to or instead of what is shown in FIG. 6. In FIG. 6, the pump controller 202 has stored in its memory an indication of the currently installed program or control software (shown as at field 244), the time and date when the program was loaded into the controller at field 246, the number of times control software has been loaded on the controller at field 248, the total run time of the controller 202, engine 16 or other component at field 250 the last run time of the controller 202 at field 252, the number of engine stops at field 254, the number of engine stalls or unintended stops at field 256, and a bar chart 258 of engine speed as a function of time. Here, the engine speeds are in 500 rpm intervals and the bar chart shows time (in hours) that the engine has been operated at each 500 rpm interval. For example, the chart shows that the engine has been run at speeds between 2,000 rpm and 2,500 rpm for a total of about 1.4 hours, and at speeds between 4,500 rpm and 5,000 rpm for about 2 hours. The time totals could be from the last programming of the controller, or total time, as desired. Of course, other data could be provided, as desired. The data may be used to determine component performance, run time, durability or for any other purpose, such as to detect system or component malfunctions or anomalies.

Further, a controller with the capability to vary the operation of the pump(s) in combination with information from a pressure sensor (e.g. sensor 174) or level sensor allows an algorithm to be developed to determine the relative level of fuel vapor and/or air in the container. For example, there is 10% liquid and 90% vapor prompting the pump to be run at full duty to fill the container. In one example, if the volume is topped off or full of fuel (filled to max desired level) then the pressure will change more rapidly if fuel is added or fuel level is decreased by changing the flow rates of the pump(s). An algorithm can be used to limit the maximum speed of the pumps when it is determined that they are running in air and limit damage that may occur to the pumps as they are running in air.

Figure 7:
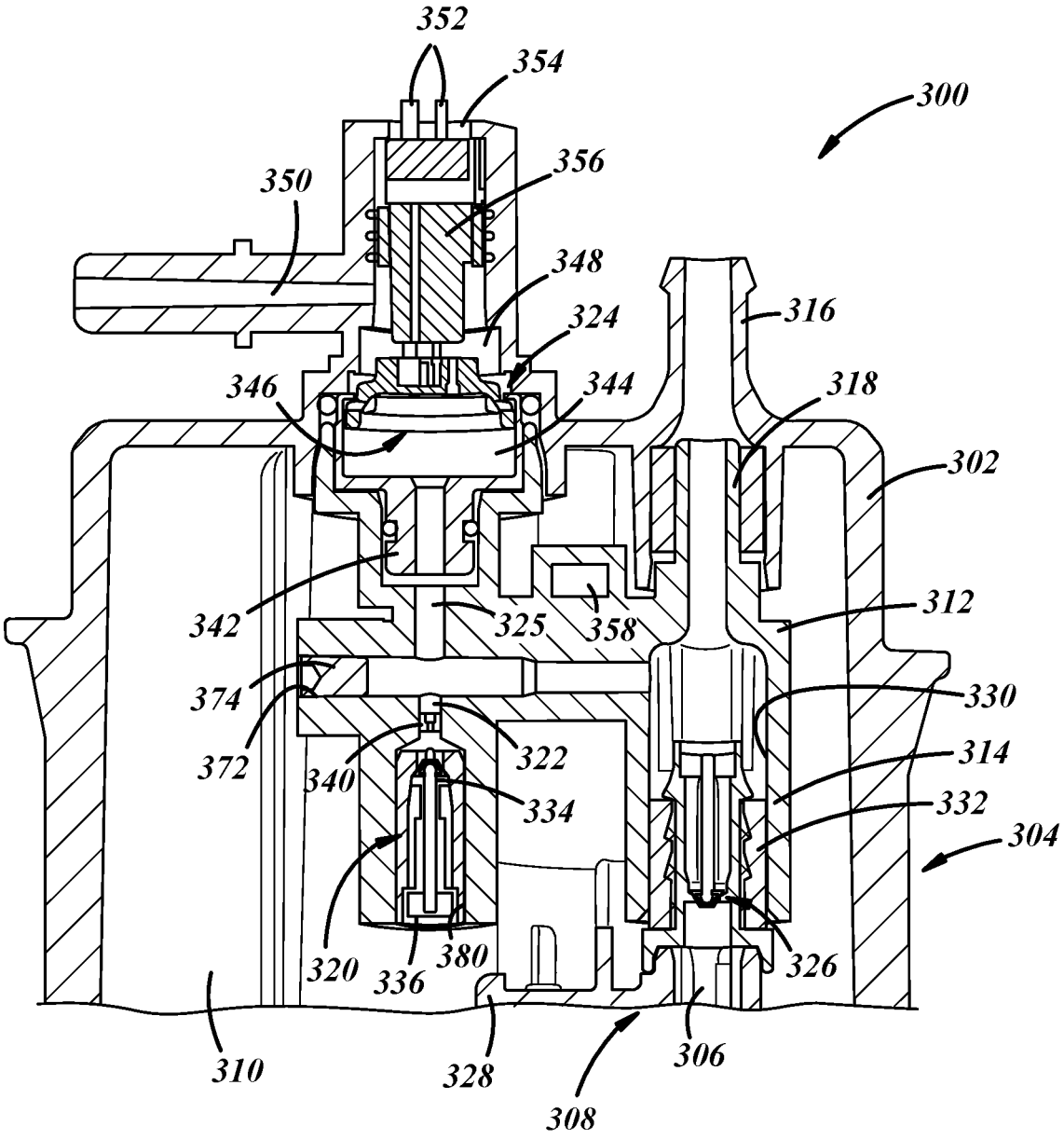
FIG. 7 is a sectional view of a portion of a fuel supply module illustrating an upper portion of a reservoir, a manifold, pressure sensor, pressure regulator and a portion of a fuel pump.
Figure 8:
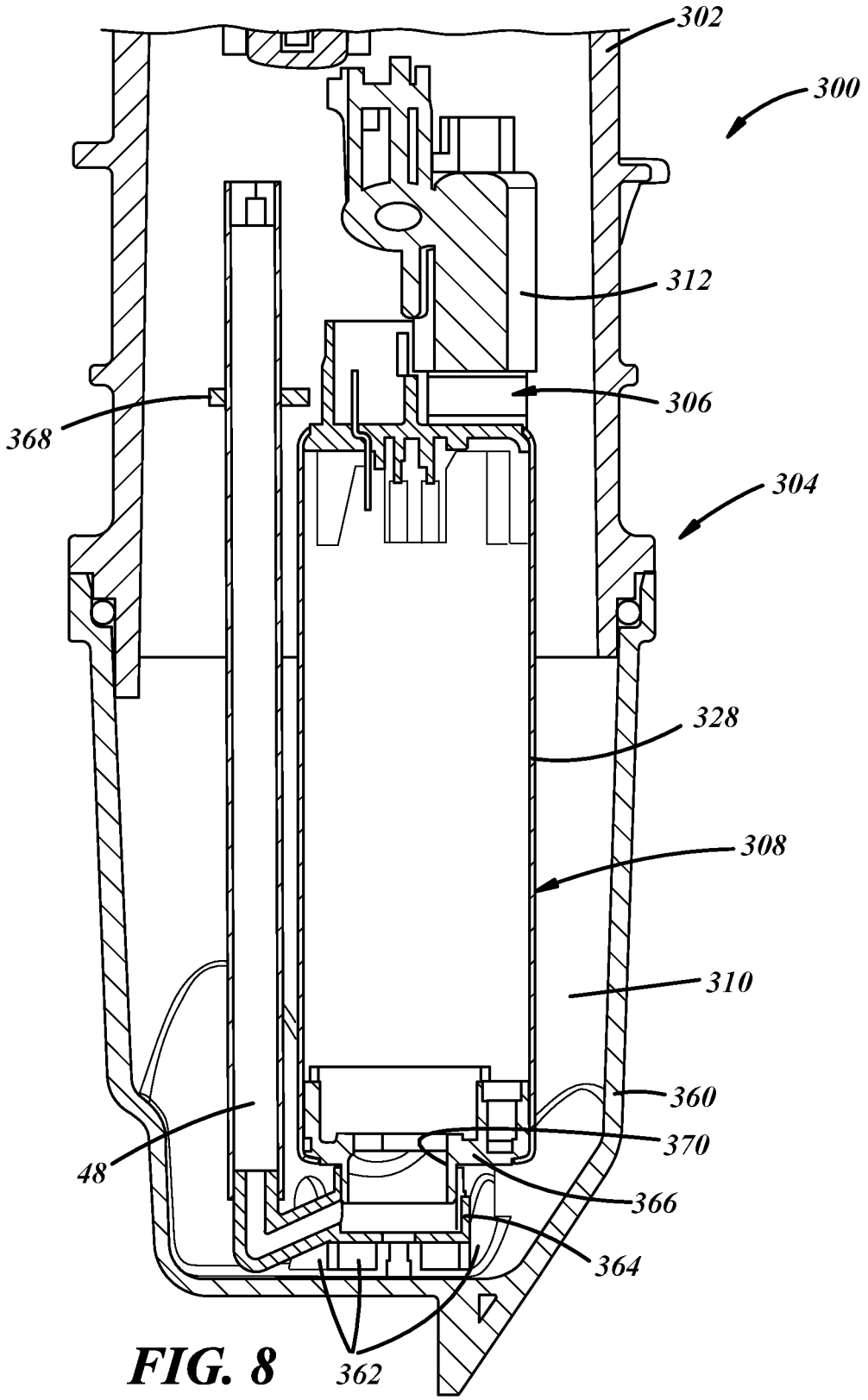
FIG. 8 is a partially sectioned view of the module shown in FIG. 7 illustrating a lower portion of the reservoir, an inlet adapter and pump mounting feature.
Figure 9:
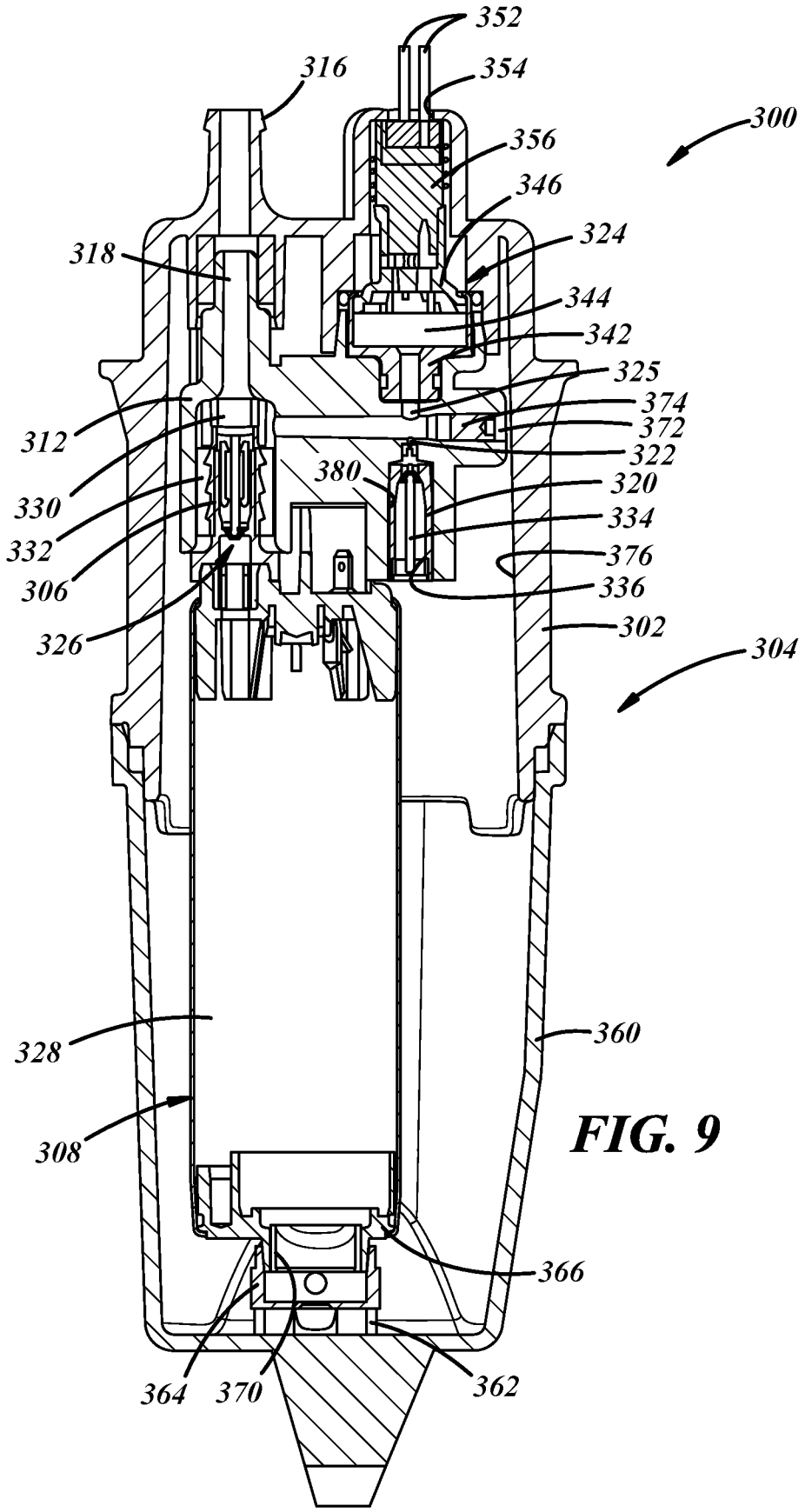
FIG. 9 is sectional view of the module.

FIGS. 7-9 illustrate part of a fuel supply module 300 including a lid or upper part 302 of a reservoir 304, an outlet 306 of a fuel pump 308 within an internal volume 310 of the reservoir, a manifold 312 having an inlet 314 coupled to the fuel pump outlet 306, an outlet 316 of the reservoir 304 through which fuel is discharged from the module 300 communicated with a first outlet 318 of the manifold 312, a pressure regulator 320 communicated with a second outlet 322 of the manifold, and a sensor 324 communicated with a third outlet 325 of the manifold. The manifold 312, pressure regulator 320 and sensor 324 may all be carried by the module 300, and in at least some implementations, the components may all be received within the internal volume 310 of the reservoir 304. These components, as have been described above and will be further noted below, may function to control the flow rate and pressure of fuel discharged from the module 300.

To prevent backflow of fuel into the reservoir 304 through the fuel pump 308, a check valve 326 may be operably associated with the fuel pump outlet 306. The valve 326 permits fluid flow out of the fuel pump outlet 306 but inhibits or prevents the reverse flow of fuel. The valve 326 may be carried by the manifold 312, by a housing 328 of the fuel pump 308 or both. In the implementation shown, the valve 326 is received at least partially within a cavity 330 of the manifold 312 that defines at least part of and/or leads to the inlet 314 of the manifold, and the valve 326 is engaged with or received at least partially within the outlet 306 of the fuel pump housing 328 which may be defined by a passage in a housing component (e.g. an end cap) of the fuel pump 308. As such, the valve 326 may provide an interface between the fuel pump 308 and the manifold 312. Appropriate seals 332 may be provided to inhibit fuel leakage from the outlet and manifold interface. Fuel that flows through the valve 326 is discharged into the manifold 312 and a portion of the fuel is communicated with the first, second and third outlets of the manifold. The portion of the fuel that flows to the first outlet 318 is discharged from the reservoir 304 and thereafter routed as desired within the fuel system. The remainder of the fuel is communicated with one or both of the regulator 320 and sensor 324.

Fuel that flows into the second outlet 322 is communicated with the pressure regulator 320 which may be of any desired construction and arrangement. As shown, a valve element 334 is yieldably biased to a closed position wherein fuel is prevented (or at least inhibited) from flowing through a bypass outlet 336 of the regulator 320 and back into the internal volume 310 of the reservoir wherein that fuel is available to again be pumped out by the fuel pump 308. When the pressure of fuel acting on the valve element 334 is above a threshold pressure (i.e. greater than the force(s) holding the valve element closed), the valve element is opened and fuel flows out of the bypass outlet 336. Hence, the fuel within the manifold 312 is maintained at or below the threshold pressure, and thereby, the fuel discharged from the reservoir outlet 316 is at or below the threshold pressure. A jet 340 (FIG. 7) or other flow controller may be provided upstream of the valve element 334 and may have a reduced flow area orifice or passage to control the flow rate of fuel into the second outlet 322. The jet 340 may be a component that is separate from the manifold 312 and which is inserted therein in assembly or during a process by which the manifold is formed (e.g. an insert molding process). To achieve different flow rates in different applications, different jets may be used in manifolds of the same construction. In this way, one manifold design may be used with a different valves, pressure sensors and in different applications of the fuel supply module, as desired. The jet 340 may also be integrally formed into the manifold 312

As discussed herein, one or more pressure sensors 324 may be used within a system to control fuel pump operation. In the example shown in FIG. 7, the pressure sensor 324 is communicated with the fuel discharged from the fuel pump 308 via the third manifold outlet 325. The fuel pressure sensor 324 may be of any desired type, including but not limited to various transducer type sensors like strain gauges, and capacitive, inductive and piezo-electric sensors. In the example shown, the pressure sensor 324 includes an inlet body 342 that is communicated with, and may be coupled and sealed to, the third manifold outlet 326 to receive fuel into the inlet body 342. The inlet body may define at least part of a chamber 344 that is open to one side of a sensor element 346 so that the sensor element is acted upon by the pressurized fuel. On the opposite side of the sensor element 346, a reference chamber 348 may be defined by a housing of the sensor, or by the module reservoir (e.g. upper portion 302). In the example shown, the sensor 324 is integrated into the module reservoir 304 and is not a self-contained unit, although it could be, or it could be incorporated into the module reservoir in other ways. The reference chamber 348 may be open to a reference inlet 350 (FIG. 7) of the module reservoir 304. The reference inlet 350 could be communicated, for example, with the atmosphere or with another pressure source such as an intake manifold of the engine. Signal wires 352 may extend from the sensor element 346 through a port 354 in the module reservoir 304 and may be routed to a controller or other interface for communication of the data from the pressure sensor 324 as desired. The wires 352 and any electrical elements/electronics associated with the sensor 324 and received within the module reservoir 304 may be sealed from the reference chamber 348 and otherwise, by a plug 356 through which the wires 352 may pass, and which may be sealed (e.g. by an o-ring, adhesive, potting, weld or otherwise) to the module reservoir 304 upstream of an end of the port 354.

To simplify assembly and inhibit or prevent the pressurized fuel from moving or shifting components, the manifold 312 may be secured to the module reservoir 304. In the implementation shown, the manifold 312 is firmly secured to the lid, or an upper portion 302 of the reservoir, such as by one or more mating connection features on the lid and manifold. As shown, the connection features include aligned bores and a screw 358 (FIG. 7) or other fastener received in the bores to maintain the position of the manifold 312 relative to the lid 302. Other connections features, for example latches, snap-fit or interference fit features may be used also or instead, as may adhesives, welding, heat staking or the like to bond the components together.

As shown in FIG. 8, to retain and/or locate the fuel pump 308 in the module reservoir 304, a lower portion 360 of the module reservoir may include one or more mounting features 362, such as a bracket, boss or the like in which a portion of the fuel pump housing 328 is received. In the example shown, the mounting feature 362 includes one or more walls that are integrally formed from the same piece of material as the remainder of the lower portion 360 of the module reservoir 304. The walls 362 may define a socket in which an inlet end cap 362 of the fuel pump housing 328 is received. Hence, the fuel pump 308 is trapped between the manifold 312 and the lower portion 360 of the module reservoir 304 and thereby inhibited or prevented from moving axially relative to the module reservoir or manifold 312. Further, a rubber or elastomeric isolator can be installed in the cavity formed by the walls 362 to mechanically isolate the pump from the reservoir 304.

The fuel pump 308 may also include other components, as noted above, and the module reservoir 304 and/or manifold 312 may be arranged to received or support such components. For example, a filter may be provided at the fuel pump inlet to filter fuel as it is drawn into the fuel pump. The filter may include a mounting body or inlet adapter 364 that is coupled to the inlet end cap 366 of the fuel pump housing 328 and the mounting feature(s) 362 may cooperate with the inlet adapter 364 instead or in addition to the inlet end cap 366 with the same effect achieved (i.e. retention of the fuel pump/fuel pump assembly). Further, the fuel pump 308 may include a tube 48 (FIG. 8) as set forth herein, and the tube may be supported by one or both of the module reservoir 304 and the manifold 312. In the example shown, the tube 48 may be coupled to or supported by a bracket 368 extending from or otherwise defined by the manifold 312.

As shown in FIGS. 8 and 9, the inlet adapter 364 may have a restricted inlet (e.g. in the tube 48 or otherwise) that is in and defines part of the flow path from the reservoir internal volume 310 to the fuel pump housing inlet 370 and which is constructed to control the flow of air and/or fuel into the fuel pump inlet 370. The tube 48 may be coupled to the inlet adapter 364, and the inlet adapter may be trapped between the lower portion 360 of the module reservoir 304 (and engaged with or retained by the mounting feature) and the inlet end cap 366 of the fuel pump housing 328. In this way, a relatively simple assembly procedure can be achieved and the number of parts needed for a wide range of fuel supply module applications can be reduced.

In assembly, the manifold 312 may be coupled to the module reservoir upper portion 302, the fuel pump 308 may be coupled to the manifold by inserting the pump outlet 306 into the manifold inlet 314 (with suitable seals therebetween), the inlet adapter 364 may be coupled to the inlet end cap 366, and the lower reservoir portion 360 (e.g. the body) may be fitted to the inlet adapter 364 and secured to the upper reservoir portion 302 (e.g. the lid). Further, as best shown in FIG. 9, one or more of the passages of the manifold 312 may be formed by internal drillings or molded-in passages, and at least one port 372 at an exterior of the manifold 312 may need to be closed by a plug 374 to prevent undesired fuel flow out of the manifold. In the example shown, the manifold 312 and module reservoir 304 are arranged so that when the manifold is installed in the module reservoir, the port 372 is located closer to a wall 376 of the module reservoir 304 than the length of the plug 374. In this way, even if the plug 374 is displaced by fluid pressure in the manifold 312, the plug is retained within the port 372 by engagement of the plug with the reservoir wall 376. In other words, the wall 376 provides a backstop against ejection of the plug 374 from the port 372. In at least some implementations, the manifold port 372 is located within 5 mm of the reservoir wall, and in some applications is within 2 or 3 mm of the wall. To aid in retaining a component in or on the manifold 312, a portion of the fuel pump housing 328 may overlap the component when the fuel pump 308 is coupled to the manifold 312. In the example shown, the fuel pump housing 328 overlaps at least a portion of the pressure regulator 320 to inhibit or prevent movement of the pressure regulator out of a pocket 380 in the manifold 312 in which the pressure regulator 320 is received. The fuel pump 308 provides a stop surface in opposition to the direction in which the pressurized fuel in the manifold 312 acts on the pressure regulator 320. Also or instead, the fuel pump 308 may overlap part of the plug 372, part of the pressure sensor 324 or both, to aid in retention of one or more of these components relative to the manifold.

FIGS. 10-13 illustrate a fuel supply module 400 including a generally cup-shaped reservoir 402, a lid or upper part 404 closing the open end of the reservoir 402, an outlet 406 of a fuel pump 408 within an internal volume 410 of the reservoir, a manifold 412 integral with or defined by the lid 404 and having an inlet 414 coupled to the fuel pump outlet 406, a first outlet 416 of the manifold 412 leading to an outlet through which fuel is discharged from the module 400, a pressure sensor 420, and a second outlet 422 of the manifold. These components, as have been described above and will be further noted below, may function to control, among other things, the flow rate and pressure of fuel discharged from the module 400.

Figure 10:
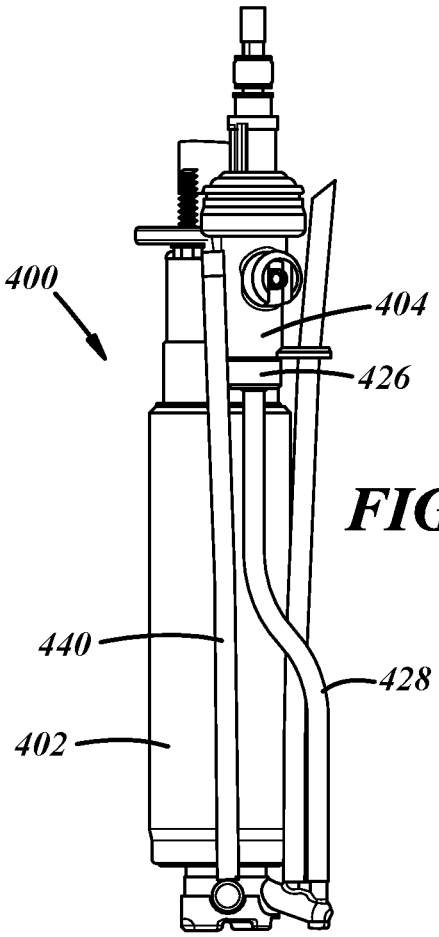
FIG. 10 is a perspective view of a fuel supply module.
Figure 11:
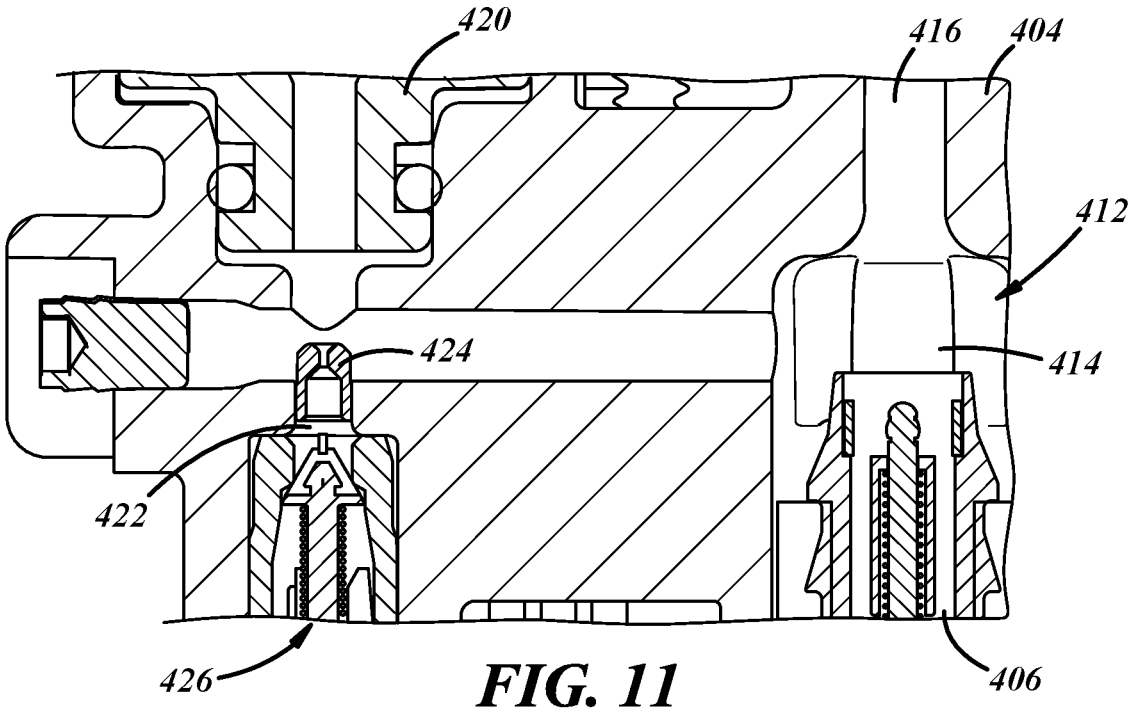
FIG. 11 is a fragmentary cross-sectional view of a manifold of the module of FIG. 10.
Figure 12:
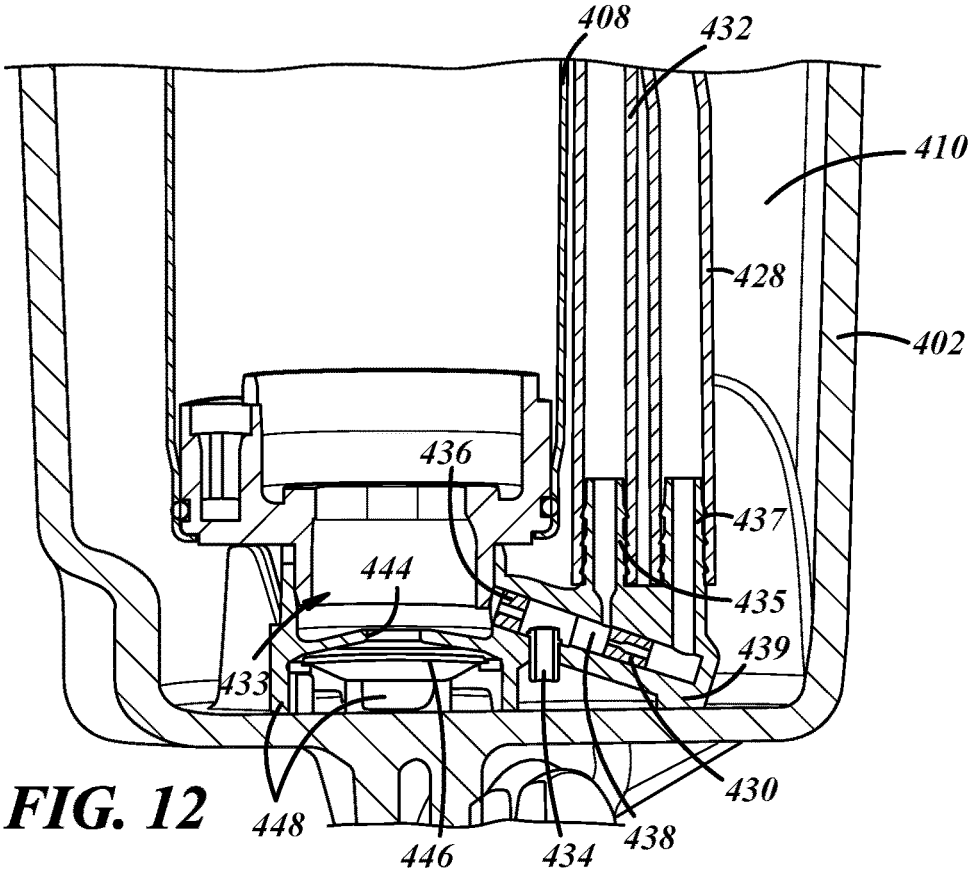
FIG. 12 is a fragmentary cross-sectional view of a lower portion of a reservoir or body of the module.

As shown in FIG. 11, the manifold 412 houses a fluid jet 424 and a pressure regulator 426 in a passage (e.g. defined in conduit 428) that carries fluid to the bottom of the reservoir 402 for intake by the pump 408. As fluid travels down the conduit 428 it turns a corner and enters a second jet 430 (FIG. 12) which may function like a jet pump. Fluid exiting the jet 430 creates a decrease in pressure that is communicated with an end of a passage 432 (defined at least in part in a tube arranged as shown in FIGS. 10 and 12) that is open near the lid 404 of the module 400 or top of a fuel tank in which the module 400 is received. This pressure drop at the passage 432 draws air from the top of the tube/passage 432 and sends it toward the inlet 433 of the pump 408.

To prohibit excess air or vapor from entering the pump inlet due to surging, one or both of an open tube, port or passage 434 and a flow restrictor 436 are further placed in the passage 438 between the jet 430 and pump inlet 433. The open passage 434 allows excess air to exit the passage 438 (which may act like a venturi tube) and the flow restrictor 436 further prohibits or restricts the flow of air or vapor or fluids to the pump inlet 433. Also, the combination of two jets 424 and 430 (one upstream of the regulator 426 and one downstream) allows more control of the pumping action of the jet pump. The conduits 428 and 432 may be coupled to fittings 435, 437 of an inlet body 439 of the module. The inlet body 439 may carry or include the jet 430, passages 434, 438, flow restrictor 436 and a main inlet passage restriction 444 that leads to the fuel pump inlet. The inlet body 439 may also carry a filter or screen 446 to remove at least some contaminants from the fuel flowing to the fuel pump inlet, and may provide standoffs or feet 448 that permit fuel to flow between them to the filter 446 and inlet passage restriction 444 from the surrounding volume in the module.

Figure 13:
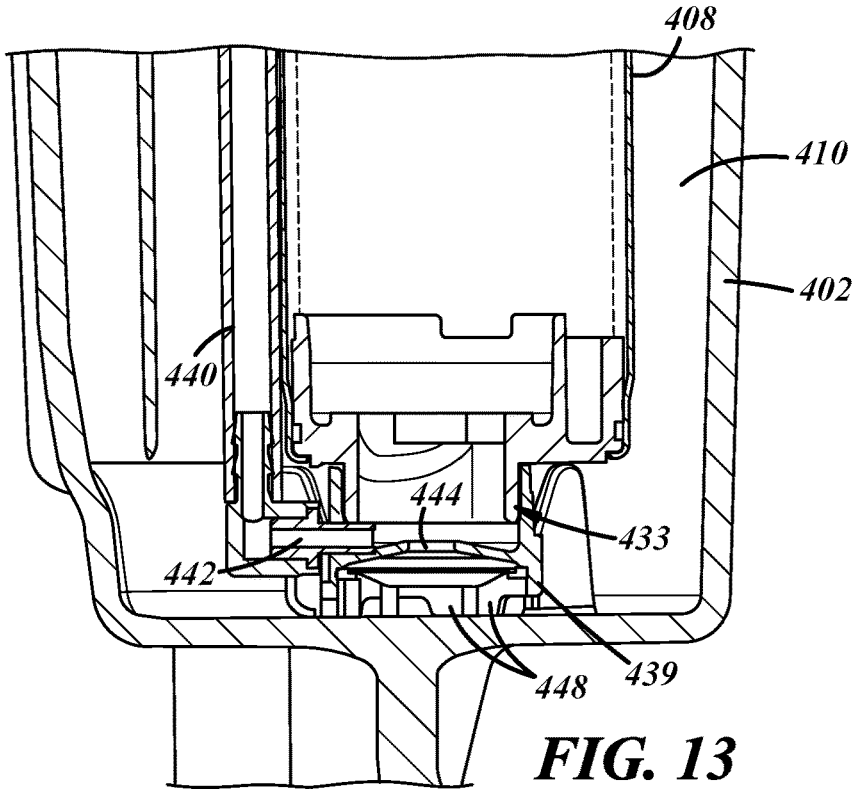
FIG. 13 is a fragmentary cross-sectional view of a lower portion of a reservoir or body of the module.

Also, in at least some implementations such as is shown in FIG. 13, further flexibility may be added to the module design by creating an additional path for fluid to enter the pump inlet 433 from the top of the reservoir 402 through a tube or passage 440 which may be vertically oriented or otherwise include an open end near the top of the module 400 (e.g. in an air/vapor space). This passage 440 opens at an end 442 that is above the main inlet passage restriction 444 so that the fluid flowing through the passage 440 does not flow through the restriction 444 before entering the fuel pump inlet 433. One intent in using the additional passage 444 is to allow the pump to ingest air or vapor within the reservoir 402 at a rate that slightly exceeds the rate that it is generated. This additional passage 444 would allow ingestion of vapor at higher flow rates at engine speeds above engine idle speed.

Figure 14:
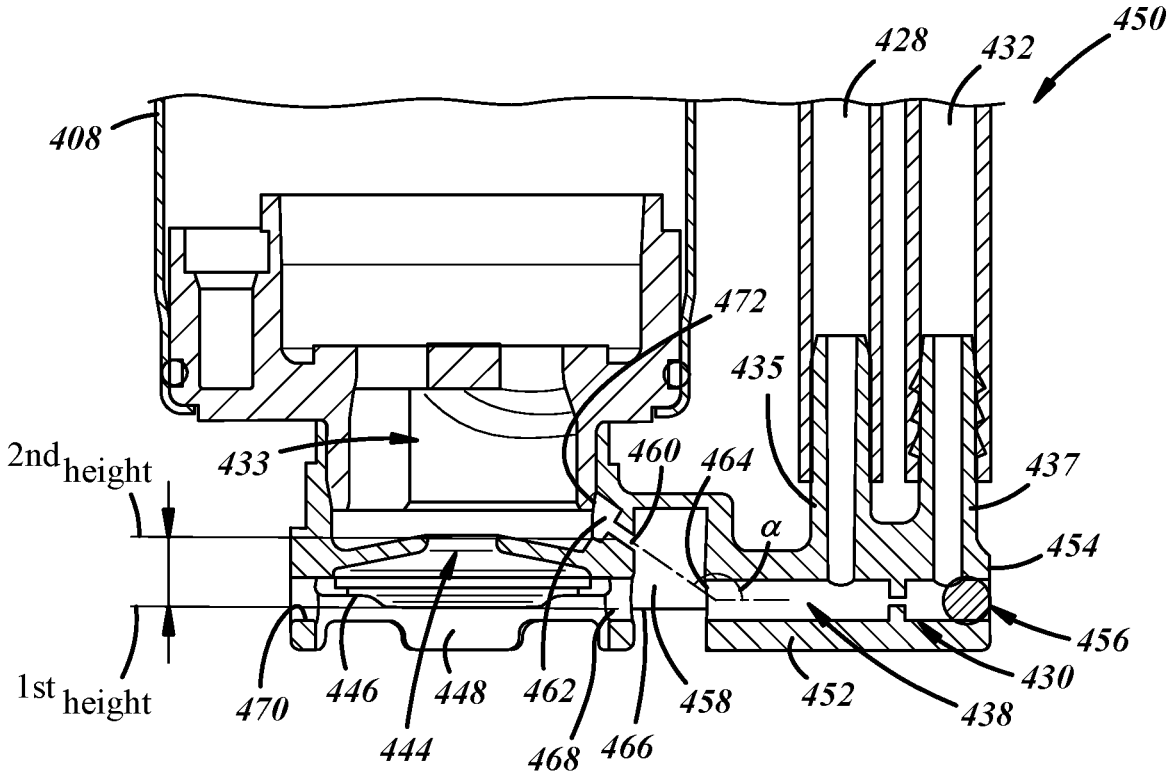
FIG. 14 is a fragmentary cross-sectional view of a lower portion of a reservoir or body of the module.
Figure 15:
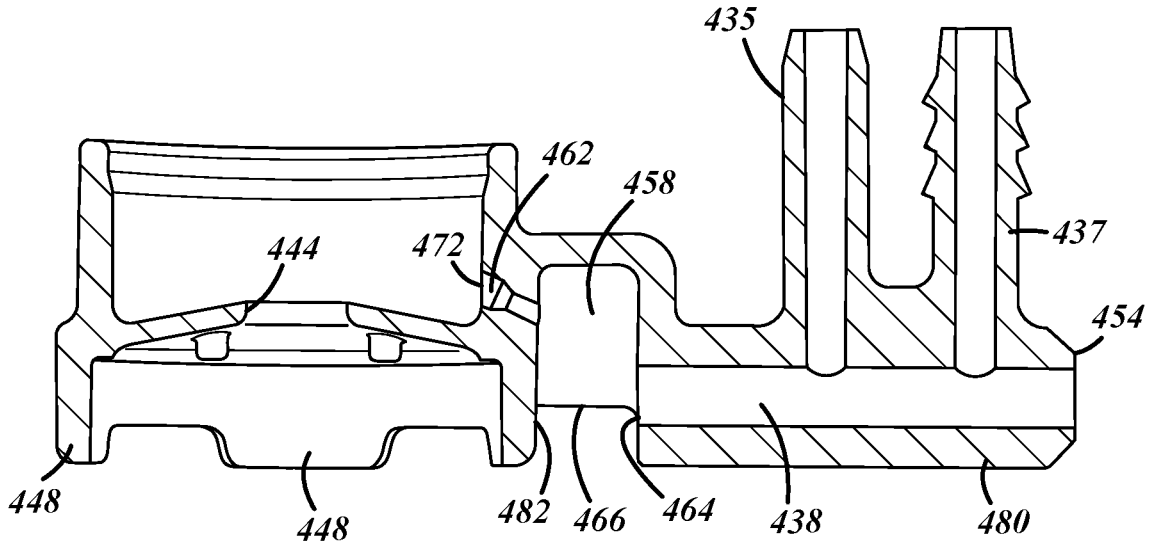
FIG. 15 is a sectional view of an inlet body of the module.
Figure 16:
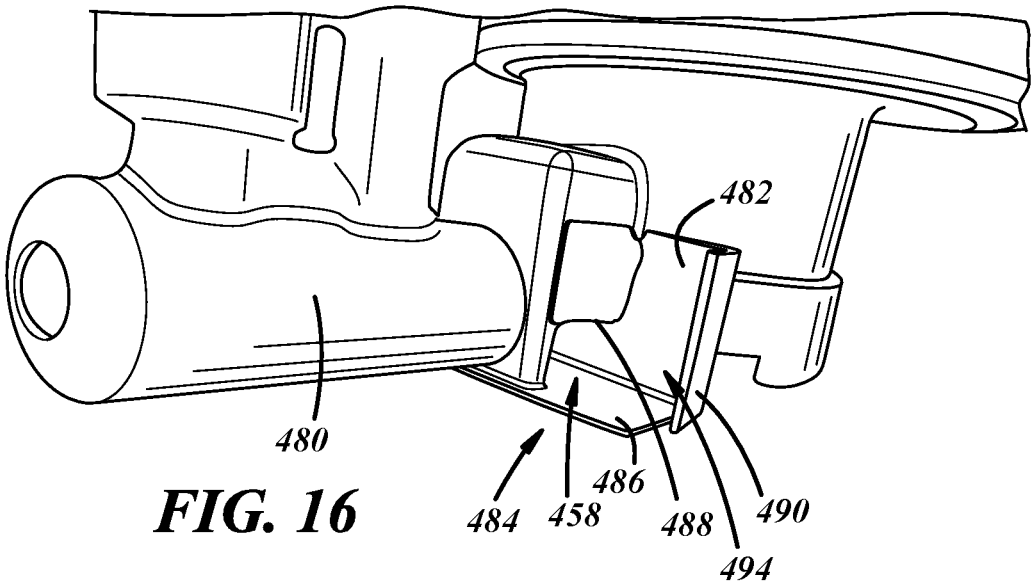
FIG. 16 is a fragmentary perspective view of a lower portion of a reservoir or body of the module.

FIGS. 14-16 illustrate another arrangement of a fuel pump assembly 450 for a fuel supply module, in particular an inlet body 452 for the fuel pump 408. Like the inlet body 439, the inlet body 452 may include one or more fittings 435, 437 that are coupled to the conduits 428, 432 and the second jet 430 which may be an insert (e.g. a component separately formed from the inlet body) or defined by a reduced diameter portion of the passage 438 integrally formed with the inlet body 452, as shown in FIG. 14. Jet 430 is within passage 438 and between the fittings 435, 437 and thus, between the conduits 428, 432 with regard to the fuel flow path toward the fuel pump inlet 433. To aid in forming the jet 430 integral with the inlet body 452, or to aid in insertion of a separate jet into the inlet body, the passage 438 may extend through the inlet body to an exterior surface 454, and may be closed by a plug 456 to prevent fuel flow out of the inlet body in the direction of the plug.

In the implementation shown in FIG. 14, the passage 438 leads to a tube or chamber 458 that has an outlet port 460 that in turn leads to a pump inlet passage 462. The passage 438 opens into or communicates with the chamber 458 at an inlet 464 of the chamber that is located at a first height and the pump inlet passage 462 opens into or communicates with the chamber 458 via the chamber outlet port 460 which is at a second height, and the second height is higher or greater than the first height, with respect to the direction of the force of gravity. In at least some implementations, the second height is measured at a center of the outlet port 460 which is at an inlet end of the pump inlet passage 462 and the first height is measured at a center of the chamber inlet 464, and the second height is at least 2 mm greater than the first height. The chamber 458 or tube may be open at its lower end 466, which may be at or below the first height in at least some implementations. The ports 468, 470 may be coaxially aligned with the passage 438 and may facilitate formation of an integral jet, for example, by insertion of a core into a mold in which the inlet body 452 is formed. In some implementations, the ports 468, 470, if provided, may be plugged or blocked to prevent fuel flow therethrough. Fuel from the reservoir may reach the filter 446 through other ports or flow areas, including but not limited to gaps between the feet 448 of the inlet body 452.

The pump inlet passage 462 may include at least a portion with a smaller flow area than the passage 438 and the chamber 458 or tube. The reduced flow area may be defined by a restriction which may be integral with the inlet body or defined by a separate insert or jet. An outlet end 472 of the pump inlet passage 462 may be located above the filter 446 and inlet restriction 444 in the inlet body for direct ingestion of fluid from the pump inlet passage to the fuel pump 408. The pump inlet passage 462 may be angled so that the outlet 472 is at a third height which is greater than the second height. An angle $\alpha$ between centerlines of the pump inlet passage 462 and the passage 438 may be between 45 and 75 degrees. The restricted flow area and angle of the pump inlet passage 462 may tend to reduce the flow rate of fluid therethrough, tend to cause liquid fuel or excess vapors to flow out of the chamber 458 through the open lower end 466 or outlet port 468 which are at the same height as or lower than the second height, and air or fuel vapor to be drawn at a controlled rate through the pump inlet passage 462 to be pumped by the fuel pump 408.

FIGS. 15 and 16 illustrate an inlet body 480 without a second outlet port (e.g. no port 468 as in the pump inlet body 452) from the chamber 458. Instead, a deflector 482 is provided axially aligned with the passage 438 and fluid must exit the chamber 458 either through the pump inlet passage 462 or through the open lower end 466 of the chamber. In FIG. 15, the deflector 482 is defined by a wall of the inlet body 480 that defines part of the chamber 458. In FIG. 16, the deflector 482 is defined by a wall of a deflector body 484 that is coupled to or otherwise carried by the inlet body 480 but formed separately from the inlet body. In FIG. 16, the chamber 458 is defined in part by the inlet body 480 and in part by the deflector body 484. In the implementation shown in FIG. 16, the deflector body 484 includes a lower wall 486 that encloses all or most of the lower end 466 of the chamber 458 and an outlet port 488 is defined by one or both of the inlet body 480 and the deflector body 484. As also shown, the deflector body 484 may include a second deflector defined by a wall 490 that is aligned with the outlet port 488 and arranged at least partially opposed or perpendicular to the direction of fluid flow out of the outlet port. Further, the second deflector 490 extends from the back wall or deflector 482 away from the fuel pump 408, and the lower wall 486 extends partially or all the way to the deflector wall 482. So arranged, the deflector body 484 defines a fuel outlet area 494 between the walls 482, 486, 490 that opens away from the fuel pump inlet so that fuel and air/vapor flows out of the chamber 458 and away from the fuel pump inlet. The liquid fuel and exhausted vapors are thus, directed away from the pump inlet and into the interior 410 of the reservoir so that air or vapor is not directed to the fuel pump inlet. Under at least some fuel flow conditions, the flow out of the chamber may be fairly turbulent and cause frothing and, bubbling in the fuel. Ingestion into the pump of the froth or bubbles can render the fuel supply to the engine inconsistent and negatively affect engine operation. Accordingly, the deflector body 484 serves to direct the more turbulent flow away from the pump inlet and into the larger volume of fuel within the reservoir interior volume wherein the froth and bubbles may settle down before being taken into the fuel pump.

As set forth above, the fuel supply module or fuel supply system may include a pressure or flow sensor to enable closed loop feedback control of the fuel pump as a function of the pressure of fuel discharged from the fuel pump or bypassed fuel flow. As also set forth above, a bypass pressure regulator may be used along with a flow sensor that detects the presence of bypassed fuel flow. The sensor in this regard could, if desired, be a switch or the like that indicates the presence of bypassed fuel flow whereupon the fuel pump output can be adjusted (e.g. PWM control) to reduce the output using an algorithm or other control scheme to minimize the bypass flow and thereby hold the pump output at or near a desired value. In at least some implementations, if the engine fuel demand were known and an algorithm/control scheme were used to control the fuel pump based on speed and or voltage and pressure, the relative difference in these two could be used to only allow a certain pressure regulator bypass flow. If this controlled bypass flow were very close to 0 lph there would be little to no difference in operation of this type of system in comparison to a pressure sensor regulated system, and the bypassed flow control system may be less costly, at least in some implementations.

Figure 18:
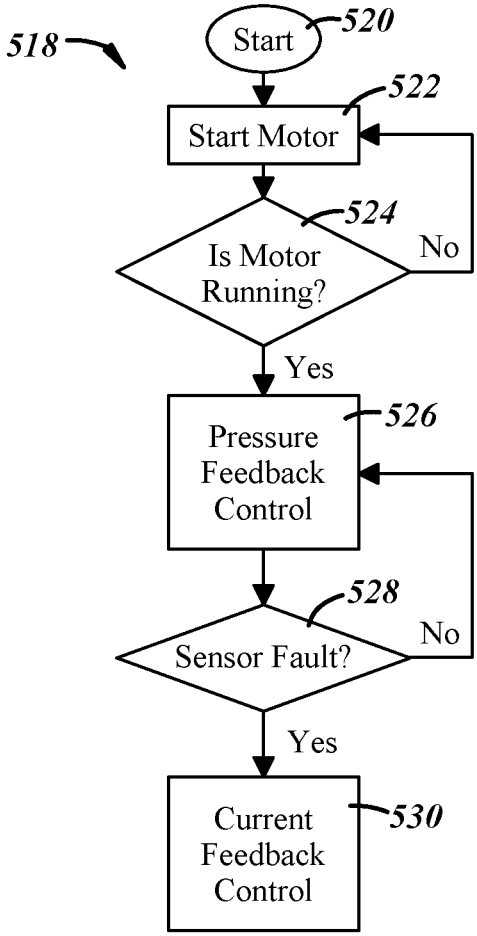
FIG. 18 is a flowchart of a fuel pump control method.
Figure 17:
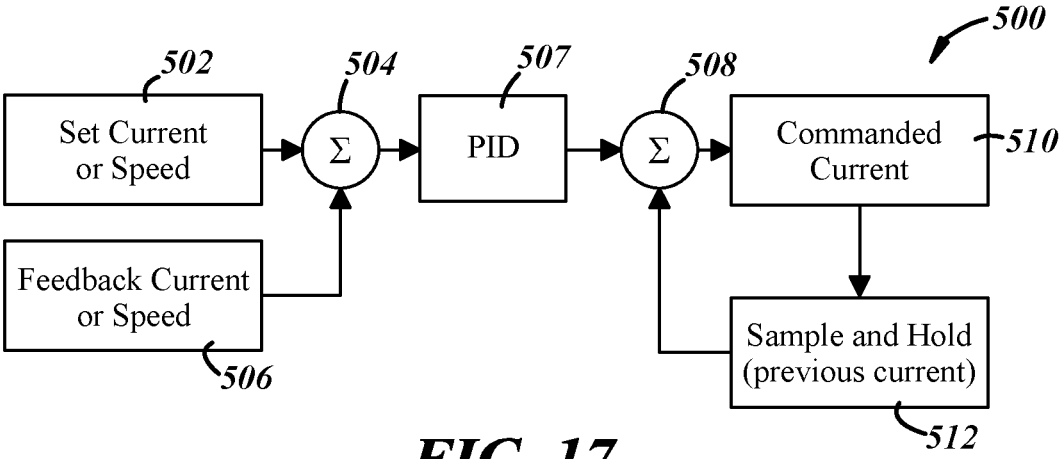
FIG. 17 is a chart of a fuel pump control scheme.

Another example of a way to control fuel flow is to use a pressure regulator and sense and control the bypass of the pressure regulator as defined in U.S. Pat. No. 6,279,541, the disclosure of which is incorporated herein by reference in its entirety. In one implementation, the system taught by the '541 patent could be modified by including the noted bypass flow switch to verify the difference between pump output and consumed engine flow. A benefit of combining these ideas is that if the output flow rate of the fuel pump drops off for any reason, the sensor/flow switch can be used to either verify or correct the output flow based on an algorithm or scheme to accommodate a shift in pump performance. FIGS. 17 and 18 illustrate a system and method for controlling the fuel pump both with the sensor or switch active and if the sensor or switch fails or is otherwise inactive.

FIG. 17 illustrates a system 500 wherein a desired current value or fuel pump motor speed value is set at 502 and added to an error value at 504. The feedback current or motor speed provided to the fuel pump is sensed or determined at 506 and subtracted from the value at 504, and the resulting value is used by a controller 507 to adjust at 508 a commanded current to the fuel pump which is supplied to the fuel pump at 510. The commanded current is sampled and stored at 512, and added to the adjustment at 508 and a previous commanded current along with the adjustment at 508 becomes the commanded current going forward, so that the commanded current is a function of the adjustment factor at 508 and the prior current value stored at 512. The fuel pump output reasonably follows the current supplied to the fuel pump, at least sufficiently to keep the engine running so that the vehicle (e.g. a boat or marine craft) may be operated and taken in for service. Various things affect the ability to accurately operate the fuel pump based upon current control, such as, the fuel system component volume which is often different in different vehicles/vessels, variability in mechanical valves and the like, volume of fuel in the reservoir, etc. Hence, this mode of current control may be used, among other possibilities, as a "limp home" mode in which a boat or other vehicle may be operated at some reduced or nominal speed to avoid the vessel and its passengers being stranded in a remote location. This mode of control provides a redundant fuel pump control scheme to enable at least some engine operation after failure of a pressure sensor.

FIG. 18 is a flowchart of a basic fuel pump control method 518. The method starts at 520 or upon starting of the motor at 522. Next, it is determined at 524 if the motor is running, and if it is not, the method returns to 522 and waits for the motor to be started. If the motor is running, the method continues to 526 wherein the fuel pump is controlled based upon closed loop pressure of flow sensor feedback. At 528, it is determined if the pressure sensor has failed. If the pressure sensor has not failed the closed loop pressure or bypass flow sensor feedback control of the fuel pump continues. If a pressure sensor fault is detected, the method proceeds to 530 in which the fuel pump is operated based upon a fuel pump current control scheme such as that set forth in FIG. 17. This mode may remain active until the motor ceases to run (e.g. the engine is stopped, such as by turning a key to an off position). Upon restarting the engine (e.g. a key is turned to on or start position), the method may return to start at 520 and repeat the above noted steps. If desired, a fault indication may be provided (e.g. illumination of a service engine light on a vehicle display panel) when it is determined or detected that the pressure or bypass flow sensor is not operating correctly. Hence, the current control method may provide a back-up or secondary control scheme in the event of a failure in the pressure or flow-based closed loop control scheme.

In some implementations, the jet pump outlet and fuel pump inlet may be immersed in liquid fuel when 50 cc or more of liquid fuel is in the reservoir. A system may also include a fuel pressure regulator that is referenced to a subatmospheric pressure source, like an engine intake manifold. Bypass flow from the regulator may feed a first conduit that sends fluid to a jet pump and a flow switch that is either mounted in the first conduit or receives flow from a branch connection (e.g. a T connection) from the first conduit such that an output signal of the flow switch can be used to control the system (e.g. the presence of fuel at the flow switch causing a first output and the absence of fuel flow at the switch causing a different output which may include no output).

In at least some implementations, a control system for a fuel pump, comprises:

a controller having or associated with memory that includes instructions or programs for operation of the controller, the controller also including:

at least one input which may include an output from a fuel pressure or fuel flow sensor, an output from a controller associated with an engine with which the fuel pump is used, a throttle position sensor of the engine, an indication of engine fuel demand and a power supply for the fuel pump; and an output to the fuel pump of a power supply the magnitude of which is dependent upon at least one of the inputs.

The control system may include a second output indicative of the performance of the fuel pump. And the output may be provided by a wireless transmitter.

In at least some implementations, a method of operating a fuel pump, comprises:

determining the difference between a set current or speed value to be provided to the fuel pump and an actual current or speed value provided to the fuel pump;

adding said difference to a previous current value to provide a commanded current that is provided to the fuel pump; and storing the commanded current as a previous current.

The method may also include the steps of:

determining with a sensor the pressure of fuel discharged from the fuel pump or a flow of bypassed fuel;

controlling the fuel pump operation as a function of the pressure of fuel discharged from the fuel pump or flow of bypassed fuel;

determining if the sensor has a fault and if the sensor does not have a fault, then controlling the pressure as a function of the pressure of fuel discharged from the fuel pump or based upon bypassed fuel flow and not as a function of the current provided to or speed of the fuel pump as set forth above, and if the sensor does have a fault, controlling the fuel pump as a function of the current provided to or speed of the fuel pump as set forth above.

The forms of the invention herein disclosed constitute presently preferred embodiments and many other forms and embodiments are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A fuel supply module, comprising:

a reservoir including a body and a lid that define an internal volume to contain a supply of fuel, the reservoir including an inlet through which fuel enters the internal volume and an outlet from which fuel is discharged from the fuel supply module; and a fuel pump carried by the reservoir and having a first inlet communicating with the internal volume to take fuel into the fuel pump from the internal volume and a second inlet open within the internal volume and spaced above the first inlet relative to the direction of the force of gravity to take gaseous matter and fuel into the fuel pump from the internal volume, and wherein the fuel pump includes an outlet from which fluid is discharged for delivery to an engine through the reservoir outlet.

2. The module of claim 1 wherein the second inlet is located in an upper third of the internal volume.

3. The module of claim 2 wherein the first inlet is located in a lower third of the internal volume.

4. The module of claim 1 wherein the second inlet has a diameter of between 0.1 mm and 7 mm.

5. The module of claim 1 wherein the second inlet is defined within a tube extending from adjacent to the first inlet at one end to a second end defining the second inlet and a pressure drop of between about 0.05 psi to 0.5 psi is needed to draw fluid through the tube.

6. The module of claim 1 which also includes a bypass line communicating with 1) the fuel pump outlet to receive at least a portion of the fuel discharged from the fuel pump outlet and with 2) a jet pump communicated with the second inlet to draw fluid through the second inlet.

7. The module of claim 6 wherein the jet pump includes a nozzle or orifice having a size between 0.2 mm to 0.8 mm.

8. The module of claim 6 wherein the flow of fluid through the jet pump creates a pressure drop that draws fluid through the second inlet.

9. The module of claim 1 wherein the fuel pump outlet is arranged closer to a bottom of the internal volume than is the second inlet.

10. The module of claim 9 wherein the fuel pump includes a pumping element and a fuel pump inlet in which fuel enters the pumping element, the fuel pump inlet is in communication with both the first inlet and the second inlet and fluid drawn into the first inlet and the second inlet are routed to the fuel pump inlet, and wherein the first inlet is located closer to the fuel pump outlet than the fuel pump inlet.

11. A fuel supply module, comprising:

a reservoir including a body and a lid that define an internal volume to contain a supply of fuel, the reservoir including an inlet through which fuel enters the internal volume and an outlet from which fuel is discharged from the fuel supply module; and a fuel pump carried by the reservoir and having a first inlet communicating with the internal volume to take fuel into the fuel pump from the internal volume and a second inlet spaced above the first inlet relative to the direction of the force of gravity to take fluid into the fuel pump from the internal volume, and wherein the fuel pump includes an outlet from which fluid is discharged for delivery to an engine through the reservoir outlet wherein the internal volume includes an inlet chamber and a primary chamber and wherein a second fuel pump is carried by the reservoir and has an inlet in communication with the inlet chamber and with a fuel supply and an outlet in communication with the primary chamber to discharge fuel from the inlet chamber into the primary chamber, and the fuel pump first inlet is in communication with the primary chamber.

12. The module of claim 11 which also includes a pressure sensor, fuel pressure regulator or a device responsive to the fuel level in the primary chamber and wherein the second fuel pump is operated as a function of feedback from said pressure sensor, fuel pressure regulator or a device responsive to the fuel level in the primary chamber.

13. The module of claim 11 which also comprises a controller coupled to the second fuel pump to control operation of the second fuel pump and wherein the other fuel pump is driven at a variable rate to provide a variable output and wherein the controller is responsive to at least one operational characteristic of the other fuel pump and controls operation of the second fuel pump as a function of said at least one operational characteristic of the other fuel pump.

14. The module of claim 13 wherein said at least one operational characteristic is at least one of the current draw of the other fuel pump or the flow rate of fuel discharged from the other fuel pump, or a rate or amount of flow in a bypass passage.

15. The module of claim 11 which also comprises a controller coupled to the second fuel pump to control operation of the second fuel pump and wherein the controller is responsive to at least one engine operating characteristic of the engine to which fuel is supplied by the fuel supply module and controls operation of the second fuel pump as a function of said at least one engine operating characteristic.

16. The module of claim 15 wherein said at least one engine operating characteristic includes at least one of a throttle position or a fuel injector duty cycle.

17. A fuel supply module, comprising:

a reservoir having an internal volume to contain a supply of fuel, the reservoir including an inlet through which fuel enters the internal volume and an outlet from which fuel is discharged from the fuel supply module;

a fuel pump carried by the reservoir and having a first inlet communicating with the internal volume to take fuel into the fuel pump from the internal volume and an outlet from which pressurized fuel is discharged;

a manifold having an inlet communicated with the fuel pump outlet, a first outlet communicating with the reservoir outlet and a second outlet communicating with a pressure sensor, the manifold and the pressure sensor being received within the internal volume with the pressure sensor received between the manifold and reservoir and not directly communicated with the internal volume.

18. The module of claim 17 which also comprises a pressure regulator and wherein the manifold includes a third outlet communicating with the pressure regulator so that fuel discharged from the fuel pump outlet is communicated with the pressure regulator, the pressure regulator being received within the internal volume.

19. The module of claim 18 wherein the fuel pump housing overlaps part of the fuel pressure regulator.

20. The module of claim 17 wherein the reservoir includes a lid and a body coupled to the lid and wherein the body includes a mounting feature that receives part of the fuel pump housing to retain and locate the fuel pump relative to the body.

21. The module of claim 17 wherein the manifold includes an external port and a plug is received within the port to inhibit fuel flow out of the port, and wherein either the fuel pump housing or a portion of the reservoir is located at a distance from the port that is less than a length of the plug.

22. A fuel supply module, comprising:

a reservoir including a body and a lid that define an internal volume to contain a supply of fuel, the reservoir including an inlet through which fuel enters the internal volume and an outlet from which fuel is discharged from the fuel supply module;

a fuel pump carried by the reservoir and having a first inlet communicating with the internal volume to take fuel into the fuel pump from the internal volume and a second inlet spaced above the first inlet relative to the direction of the force of gravity to take fluid into the fuel pump from the internal volume, and wherein the fuel pump includes an outlet from which fluid is discharged for delivery to an engine through the reservoir outlet;

a fuel pressure regulator having an inlet in communication with the outlet of the fuel pump and a valve that is opened when the fuel pressure at the inlet is greater than a threshold value, and a bypass outlet through which fuel is discharged from the pressure regulator when the valve is open;

a first conduit through which fuel flows from the fuel pressure regulator outlet;

a second conduit having an open end that defines the second inlet;

an inlet body having at least one passage that communicates with the first conduit and the second conduit to direct fluid flow from both conduits toward the fuel pump inlet; and at least one flow restrictor carried by the inlet body to control the flow rate of fluid from the inlet body to the fuel pump inlet.

23. The module of claim 22 wherein the flow restrictor is located between the first conduit and second conduit with regard to the direction of fluid flow in the passage of the inlet body.

24. The module of claim 22 wherein the inlet body includes a chamber between the fuel pump inlet and both conduits such that fluid that flows from both conduits must flow through the chamber before entering the fuel pump inlet, and wherein the chamber includes an inlet that communicates both conduits with the chamber and an outlet that is located above the height of the inlet to the chamber.

* * * * *